US006807753B2

(12) United States Patent
Steszyn et al.

(10) Patent No.: US 6,807,753 B2
(45) Date of Patent: Oct. 26, 2004

(54) SHOE WITH TUNABLE CUSHIONING SYSTEM

(75) Inventors: Michael Steszyn, Portland, OR (US); Michel Lussier, Portland, OR (US); John Acevedo, Portland, OR (US); Sandro Romedi Nigg, Portland, OR (US); Toren Phillip Ben Orzeck, Portland, OR (US); Ryan Lane Wilday, Portland, OR (US); Josh Robert Gordon, Nürnberg (DE)

(73) Assignee: adidas International B.V., Amsterdam (NL)

( * ) Notice: Subject to any disclaimer, the term of this patent is extended or adjusted under 35 U.S.C. 154(b) by 19 days.

(21) Appl. No.: 10/144,440

(22) Filed: May 13, 2002

(65) Prior Publication Data

US 2003/0208928 A1 Nov. 13, 2003

(51) Int. Cl.[7] ..... A43B 13/18
(52) U.S. Cl. ..... 36/28; 36/25 R; 36/27
(58) Field of Search ..... 36/28, 118.5, 118.6, 36/30 R, 25 R, 31

(56) References Cited

U.S. PATENT DOCUMENTS

| | | | | |
|---|---|---|---|---|
| 1,566,350 A | | 12/1925 | Smith | |
| 3,267,592 A | | 8/1966 | Champion | |
| 3,377,723 A | | 4/1968 | England | |
| 3,668,792 A | | 6/1972 | York | |
| 3,738,025 A | * | 6/1973 | Hanson et al. | 36/119.1 |
| 3,777,419 A | | 12/1973 | Nalick | |
| 3,785,646 A | * | 1/1974 | Ruskin | 36/132 |
| 3,807,060 A | * | 4/1974 | Hanson et al. | 36/119.1 |
| 4,146,980 A | | 4/1979 | Cross | |
| 4,342,158 A | | 8/1982 | McMahon et al. | |
| 4,364,188 A | | 12/1982 | Turner et al. | |
| 4,391,048 A | | 7/1983 | Lutz | |
| 4,417,408 A | | 11/1983 | Metro | |
| 4,429,474 A | | 2/1984 | Metro | |
| 4,430,810 A | | 2/1984 | Bente | |
| D273,531 S | | 4/1984 | Bidegain | |
| 4,455,766 A | | 6/1984 | Rubens | |
| 4,573,279 A | * | 3/1986 | Feurer-Zogel et al. | 36/35 R |
| 4,608,768 A | | 9/1986 | Cavanagh | |
| 4,624,061 A | | 11/1986 | Wezel et al. | |
| 4,864,738 A | | 9/1989 | Horovitz | |
| 4,864,744 A | * | 9/1989 | Walkhoff | 36/118.6 |
| 4,918,838 A | | 4/1990 | Chang | |
| 5,005,300 A | | 4/1991 | Diaz et al. | |
| 5,036,640 A | | 8/1991 | Rosen | |
| 5,086,574 A | | 2/1992 | Bacchiocchi | |
| 5,175,946 A | | 1/1993 | Tsai | |

(List continued on next page.)

FOREIGN PATENT DOCUMENTS

| | | |
|---|---|---|
| CH | 279265 | 3/1952 |
| FR | 944890 | 3/1947 |
| FR | 2448308 | 5/1979 |
| GB | 2 023 405 | 1/1980 |
| GB | 2 145 615 | 4/1985 |
| GB | 2 203 025 | 10/1988 |
| GB | 2 221 378 | 7/1990 |
| JP | 3170103 | 7/1991 |
| RU | 751391 | 7/1980 |
| WO | WO 90/00866 | 2/1990 |

*Primary Examiner*—Ted Kavanaugh
(74) *Attorney, Agent, or Firm*—Testa, Hurwitz & Thibeault, LLP

(57) ABSTRACT

The invention is directed to cushioning systems for athletic shoes that can be adjusted by a wearer. The systems include one or more cushioning inserts having anisotropic properties and are lockable in place in the shoe sole. The systems may also include structural support elements that provide additional stability and support to the wearer's foot. The wearer can adjust the degree of cushioning by rotating the insert within the shoe. The wearer can also remove the insert and replace the insert with a new and/or different insert.

43 Claims, 25 Drawing Sheets

U.S. PATENT DOCUMENTS

| | | | |
|---|---|---|---|
| 5,195,256 | A | 3/1993 | Kim |
| 5,212,878 | A | 5/1993 | Burke et al. |
| 5,363,570 | A | 11/1994 | Allen et al. |
| D354,617 | S | 1/1995 | Kilgore |
| 5,533,280 | A | 7/1996 | Halliday |
| 5,544,431 | A | 8/1996 | Dixon |
| 5,560,126 | A | 10/1996 | Meschan et al. |
| 5,572,804 | A | 11/1996 | Skaja et al. |
| 5,596,819 | A | 1/1997 | Goldston et al. |
| 5,649,374 | A | 7/1997 | Chou |
| 5,651,196 | A | 7/1997 | Hsieh |
| 5,678,327 | A | 10/1997 | Halberstadt |
| 5,718,063 | A | 2/1998 | Yamashita et al. |
| D393,339 | S | 4/1998 | Fogg |
| 5,761,831 | A | 6/1998 | Cho |
| 5,778,560 | A | 7/1998 | Danieli |
| 5,875,568 | A | 3/1999 | Lennihan, Jr. |
| 5,907,911 | A | 6/1999 | Huang |
| 5,918,384 | A | 7/1999 | Meschan |
| 5,970,628 | A | 10/1999 | Meschan |
| 5,983,529 | A | 11/1999 | Serna |
| 5,985,383 | A | 11/1999 | Allen et al. |
| 6,023,859 | A | 2/2000 | Burke et al. |
| 6,041,521 | A | 3/2000 | Wong |
| 6,050,001 | A | 4/2000 | Ditrtrich |
| 6,050,002 | A | 4/2000 | Meschan |
| 6,176,025 | B1 | 1/2001 | Patterson et al. |
| 6,253,466 | B1 | 7/2001 | Harmon-Weiss et al. |
| 6,311,413 | B1 | 11/2001 | Chern et al. |

* cited by examiner

SHOE WITH TUNABLE CUSHIONING SYSTEM

TECHNICAL FIELD

The invention generally relates to adjustable cushioning systems for articles of footwear.

BACKGROUND INFORMATION

Conventional athletic shoes include an upper and a sole. The sole is usually manufactured of a material chosen to optimize a particular function of the shoe, for example, cushioning or stiffness. Typically, the sole includes a midsole and an outsole, either of which can include, for example, a cushioning material to protect a wearer's foot and leg. One drawback with conventional shoes is that the wearer has to select a specific shoe to get optimum performance for a specific activity. For example, the wearer has to use one type of shoe for running and another type of shoe for basketball, because one shoe has more cushioning while the other is stiffer for greater support during lateral movement.

Shoes have been designed that attempt to combine and optimize different functions of sport specific shoes; however, the wearer is still left with a shoe with set functionality that the wearer cannot customize. What may be optimal for one segment of the population is not necessarily optimal for everyone. For example, many shoes are designed with wedges or varying degrees of cushioning across the width of the sole to compensate for pronation or supination. Unfortunately, these shoes are typically limited to compensating for either pronation or supination and the amount of compensation cannot be varied to suit a particular wearer. Furthermore, shoes have been designed that attempt to give a wearer some adjustability with respect to a specific function; however, these shoes may require at least partial disassembly of the shoe and/or the wearer may be limited in the amount of adjustment that can be made.

U.S. Pat. No. 5,875,568, the disclosure of which is hereby incorporated herein by reference in its entirety, discloses a cushioning system including a cylindrical shock-absorbing insert located in a heel of a shoe. Similarly, U.S. Pat. Nos. 4,430,810 and 4,573,279, the disclosures of which are hereby incorporated herein by reference in their entireties, also disclose cylindrical inserts located in the heel of the shoe. There are several drawbacks to these cushioning systems. For example, the inserts are isotropic. To adjust the cushioning properties of an isotropic insert, the wearer has to remove the insert and replace the insert with another insert having different cushioning properties. The '568 patent discloses rotating the insert to "renew" the cushioning effect of the insert, but the cushioning effect is the same no matter what orientation is selected. In addition, the inserts can "turn" during use, because there is no mechanism for locking the inserts against rotational movement during use.

There is, therefore, a need for a shoe that the wearer can easily, repeatedly, and securely customize. Such a shoe should give the wearer the ability to make numerous adjustments to the functional characteristics of the shoe, for example, increased cushioning, compensation for pronation, compensation for supination, etc.

SUMMARY OF THE INVENTION

The invention is directed to adjustable cushioning systems for articles of footwear that can be customized by a wearer. The systems include one or more cushioning inserts having an anisotropic property afforded, for example, by a multiple density construction. The systems may also include structural support elements that provide additional stability and support to the foot. The wearer can adjust the degree of cushioning by rotating the insert within the shoe. Alternatively, the insert could be moved, flipped, or otherwise displaced relative to the shoe to adjust the degree of cushioning. The wearer could also remove the insert and replace the insert with a new and/or different insert. In addition, the insert can be locked in a predetermined position to maintain a specific performance characteristic.

In one aspect, the invention generally relates to an adjustable cushioning system for an article of footwear. The system includes an insert adapted to be received in an aperture formed in a sole of the article of footwear and a locking mechanism disposed proximate the insert for maintaining the insert in a predetermined position or orientation. The insert has an anisotropic property about a longitudinal axis thereof and can be reoriented rotationally in the article of footwear to modify a performance characteristic thereof. The anisotropic property may be compressibility, resiliency, compliancy, elasticity, damping, energy storage, stiffness, or combinations thereof. In various embodiments, the insert is made of a multiple density foam. In another embodiment, the insert may include a skeletal element. In yet another embodiment, the insert is made of a combination of a skeletal element and a multiple density foam. Alternatively, the insert could be made of a first material having a first hardness, a second material having a second hardness, and a third material having a third hardness, for example.

In another aspect, the invention relates to an article of footwear including a sole and an adjustable cushioning system. The system includes an insert adapted to be received in an aperture formed in the sole of the article of footwear and a locking mechanism disposed proximate the insert for maintaining the insert in a predetermined orientation. The insert has an anisotropic property about a longitudinal axis thereof and can be reoriented rotationally in the article of footwear to modify a performance characteristic thereof. The anisotropic property may be compressibility, resiliency, compliancy, elasticity, damping, energy storage, stiffness, or combinations thereof. The system can be located in a heel region and/or a forefoot region of the sole of the article of footwear. In one embodiment, the sole includes an outsole and a midsole, and the insert is disposed at least partially within the midsole of the article of footwear.

In one embodiment, the locking mechanism includes a lever coupled to the insert for rotatably positioning the insert and a mating groove for receiving and maintaining the lever and the insert in a predetermined position. The groove may be disposed in a casing disposed about an end of the insert. Alternatively, the groove could be disposed in a portion of the sole or another structural element disposed within the sole. The lever has a locked position and an unlocked position. The locking mechanism may further include a second mating groove for receiving and maintaining the lever in a second predetermined position. The locking mechanism may also include a detent and an engagement mechanism disposed adjacent the detent. The engagement mechanism has a notch that is engageable with the detent to help maintain the orientation of the insert and/or to indicate to a wearer the position of the insert. The locking mechanism may include a visual position indicator, an audible position indicator, or both. The locking mechanism may be at least partially disposed within a retainer ring circumscribing an end of the insert. The locking mechanism may be disposed on a medial side, lateral side, or heel portion of the article of footwear.

In additional embodiments, the adjustable cushioning system includes a casing disposed in the sole and defining a recess for receiving the insert. The casing may be a retainer ring that circumscribes an end of the insert. The adjustable cushioning system may include a second casing. The second casing may be a retainer ring that circumscribes an opposite end of the insert. In addition, the casing could be a first plate disposed above the insert and a second plate disposed below the insert and coupled to the first plate at an end thereof. In addition, the adjustable cushioning system may include a second insert adapted to be received in the aperture formed in the sole of the article of footwear and a second locking mechanism disposed proximate the second insert for maintaining the second insert in a predetermined position. The second insert has an anisotropic property about, a longitudinal axis thereof and can be reoriented rotationally in the article of footwear to modify a performance characteristic thereof. The second insert may be oriented generally parallel to the first insert.

In additional embodiments, the insert may include a shaft generally longitudinally disposed therein. The shaft may be used to facilitate insertion, removal, and reorientation of the insert, for example. The insert may have a generally cylindrical shape and may define one or more generally longitudinally disposed apertures. The insert may further include a cap and/or an orientation indicator disposed on an end thereof. In still other embodiments, the insert includes an internal support and an external cushioning element disposed about at least a portion of the internal support. The external cushioning element may have a lower durometer than the internal support. The insert may include an axle disposed within the internal support. Also, the internal support may include a rib disposed on an external surface thereof. The internal support may have a cross-section, such as polygonal, arcuate, or combinations thereof, and may span an entire width of the insert.

In yet another aspect, the invention generally relates to an adjustable cushioning system for an article of footwear. The system includes an insert adapted to be received in an aperture formed in a sole of the article of footwear. The insert has an anisotropic property about a longitudinal axis thereof and can be reoriented rotationally in the article of footwear to modify a performance characteristic thereof. The anisotropic property can be selected from the group consisting of compressibility, resiliency, compliancy, elasticity, damping, energy storage, and stiffness. The insert can include an internal support and an external cushioning element disposed about at least a portion of the internal support. In one embodiment, the external cushioning element has a lower durometer than the internal support.

In various embodiments, the adjustable cushioning system includes an axle disposed within the internal support. The insert can have essentially any cross-sectional shape, such as polygonal, arcuate, or combinations of polygonal and arcuate elements. In the present application, the term polygonal is used to denote any shape including at least two line segments, such as rectangles, trapezoids, and triangles. Examples of arcuate shapes include circular and elliptical. In a particular embodiment, the insert has a generally cylindrical shape. The insert can include a handle disposed on an end thereof. Further, the external cushioning element and/or the internal support can include a generally longitudinally disposed aperture. In one embodiment, the aperture can be substantially parallel to the internal support. In another embodiment, the external cushioning element and/or the internal support can include a second generally longitudinally disposed aperture. In additional embodiments, the internal support can include one or more ribs disposed on an external surface thereof. The internal support can have a cross section that is polygonal, arcuate, or combinations thereof. The internal support can span substantially an entire width of the insert.

In addition, the adjustable cushioning system can include a structural support casing disposed in a sole of the article of footwear and defining a recess for housing the insert. The structural support casing may have a generally recumbent V or U-shaped cross-sectional profile. Furthermore, the adjustable cushioning system can include a second insert. The second insert can include an internal support and an external cushioning element disposed about at least a portion of the internal support. In an embodiment of the invention that includes a structural support casing, the second insert can be disposed in a second cylindrical recess in the structural support casing.

Furthermore, the adjustable cushioning system can be generally longitudinally disposed within the article of footwear and can extend from about the heel region to about an arch region of the article of footwear. Alternatively, the adjustable cushioning system can be generally laterally disposed within the article of footwear and can span substantially an entire width of the article of footwear. In addition, the insert can be diagonally disposed within the article of footwear. The inserts may be removable from the article of footwear so they can be replaced when they wear or when different inserts having different characteristics are desired.

These and other objects, along with advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

Figure 1:
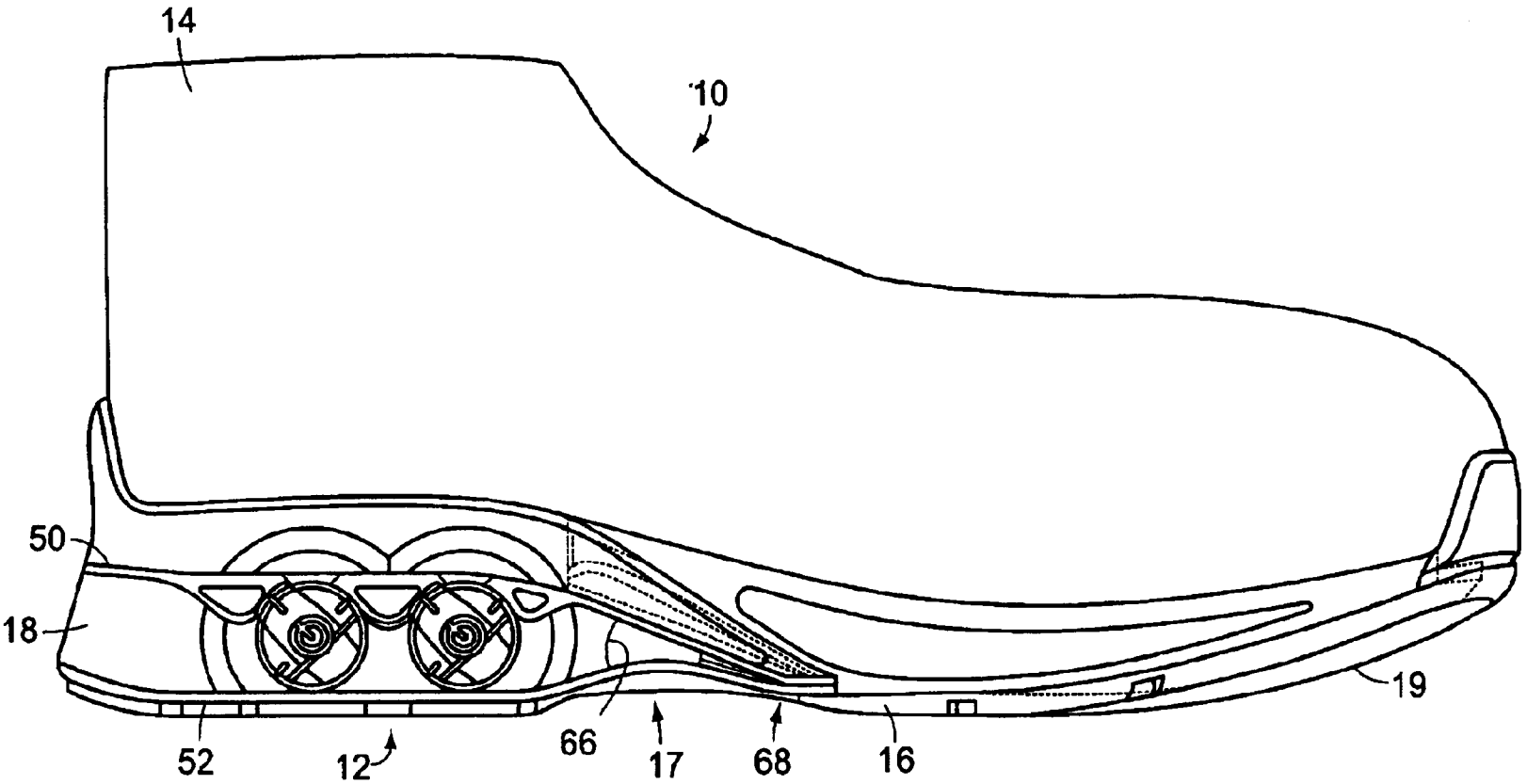
FIG. 1 is a schematic view of a medial side of an article of footwear including an adjustable cushioning system in accordance with the invention.

FIG. 1 depicts a medial side of an article of footwear 10 including an embodiment of an adjustable cushioning system 12 in accordance with the invention. Generally, the article of footwear 10 includes an upper 14 and a sole 16. The sole 16 includes a heel region 18, an arch region 17, and a forefoot region 19. The adjustable cushioning system 12 is shown disposed generally in the heel region 18 of the sole 16; however, the adjustable cushioning system 12 could be disposed anywhere along the length and width of the article of footwear 10. Additionally, the adjustable cushioning system 12 shown includes two inserts 20, as shown in greater detail in FIG. 2B; however, the adjustable cushioning system 12 could include a single insert 20 or more than two inserts 20, as necessary, to suit a particular application. In addition, an upper plate 50 and a lower plate 52 are shown and are described in greater detail hereinbelow.

Figure 2A:
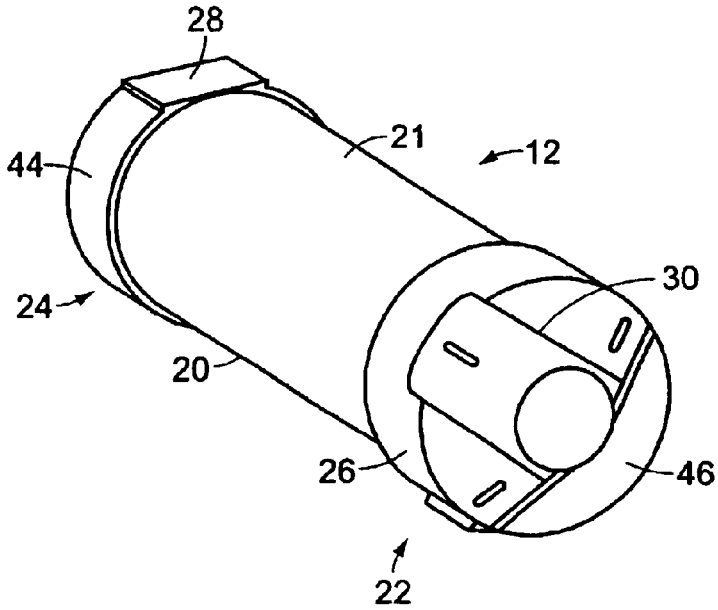
FIG. 2A is a schematic perspective view of an adjustable cushioning system in accordance with the invention and having a single insert.

FIGS. 2A–2F depict various embodiments and views of the adjustable cushioning system 12. FIG. 2A depicts an adjustable cushioning system 12 having a single insert 20. The insert 20 includes a first end 22 and a second end 24. A first optional casing 26 is disposed about the first end 22 of the insert 20 and a second optional casing 28 is disposed about the second end 24 of the insert 20. The optional casings 26, 28 act to stiffen and support the insert 20 within the adjustable cushioning system 12. In one embodiment, the casings 26, 28 are flexible and compress with the inserts 20. The insert 20 can be retained in the casings 26, 28 by frictional engagement or other mechanical means. In one embodiment, the casings 26, 28 are rigidly mounted within the sole 16 and the insert 20 is rotatably inserted into the casings 26, 28. Located at the first end 22 is an optional locking mechanism 30 for positively maintaining the insert 20 in a predetermined orientation within the adjustable cushioning system 12 and, correspondingly, the article of footwear 10. In an alternative embodiment, the insert 20 may be retained in place by a frictional fit. Depending on the aggressiveness of use, however, the insert 20 may rotate within the sole to achieve a position of lesser resistance and therefore, use of the locking mechanism may be advantageous. The locking mechanism 30 is described hereinbelow in greater detail with respect to FIGS. 4A, 4B, and 5A–5D.

Figure 2B:
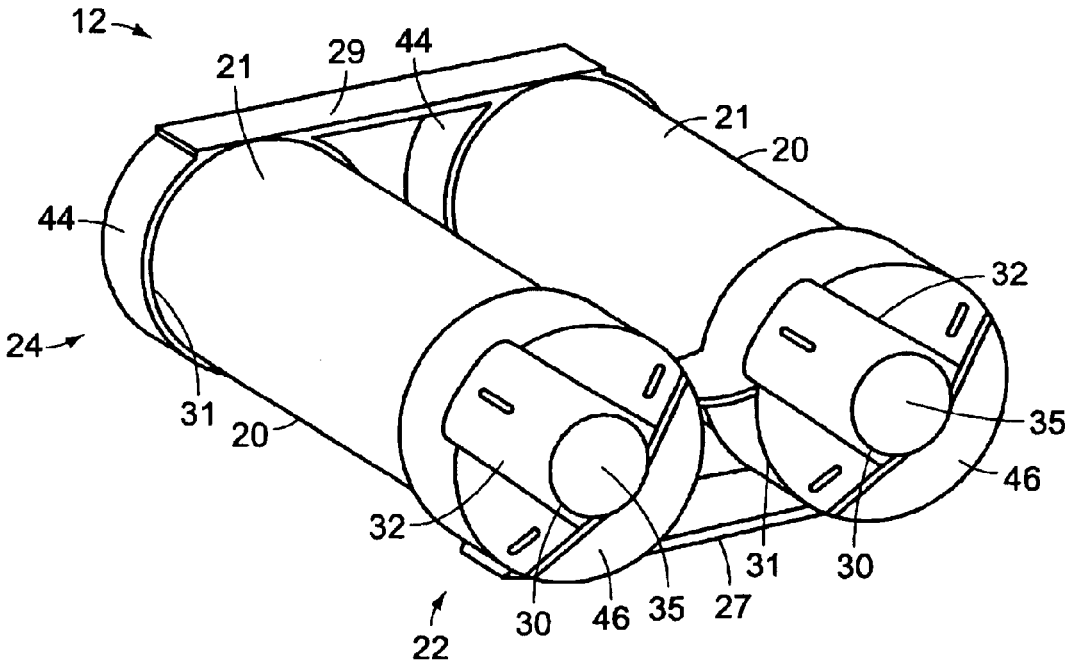
FIG. 2B is a schematic perspective view of an adjustable cushioning system in accordance with the invention and having two inserts.

FIG. 2B depicts the adjustable cushioning system 12 of FIG. 1. The adjustable cushioning system 12 includes two inserts 20 disposed generally parallel to one another. In this embodiment, an optional casing 27 is disposed about the first end 22 of each insert 20. The casing 27 is essentially two retainer rings 31 circumscribing the first ends 22 of the inserts 20. A second optional casing 29 is shown disposed about the second end of each insert 20. Each casing 27, 29 could be a single integral piece or separate pieces coupled together. The casings 27, 29 act to stiffen and support the insert 20 within the adjustable cushioning system 12. In one embodiment, the casings 27, 29 are flexible and compress with the inserts 20. In an embodiment with two or more inserts 20, the casings 27, 29 also maintain the inserts 20 in their proper positions relative to one another.

Figure 2C:
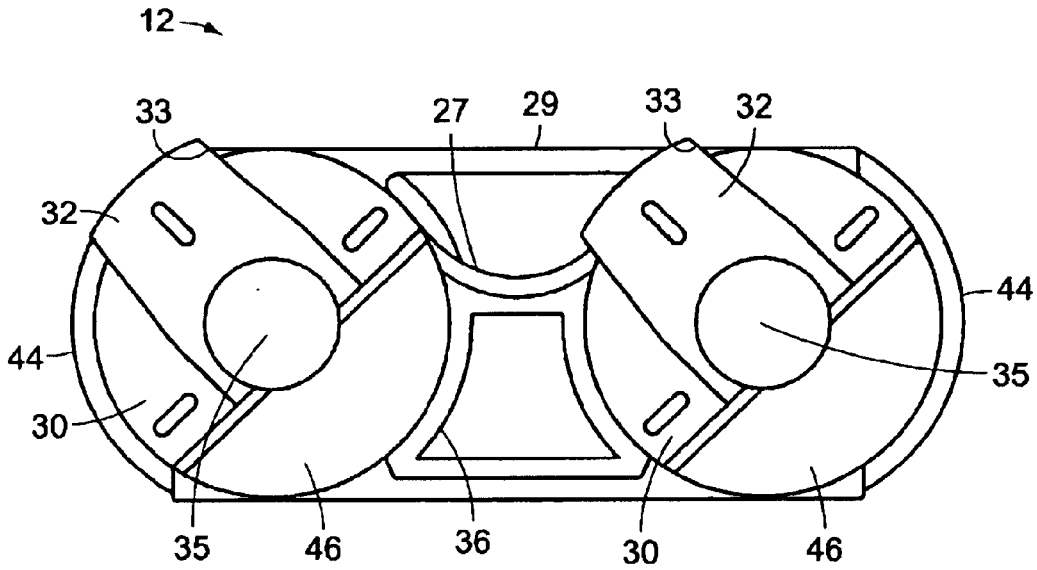
FIG. 2C is a schematic end view of the adjustable cushioning system of FIG. 2B.
Figure 2D:
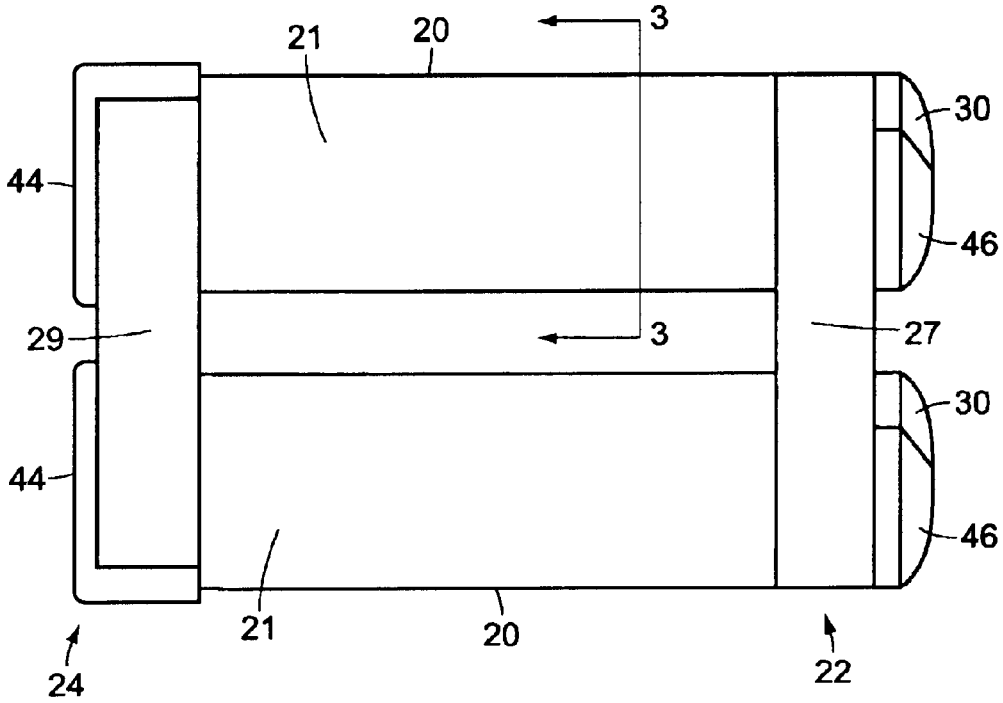
FIG. 2D is a schematic top view of the adjustable cushioning system of FIG. 2B.

FIGS. 2C and 2D are an end view and a top view of the adjustable cushioning system of FIG. 2B, respectively. FIG. 2C depicts the first ends 22 of the inserts 20 and the locking mechanisms 30 disposed thereon. Each locking mechanism 30 includes a lever 32 coupled to a hub 35 and seated within a groove 33. The locking mechanism 30 is described in greater detail with respect to FIGS. 4A, 4B, and 5A–5D. FIG. 2D depicts the adjustable cushioning system 12 having two inserts 20 disposed generally parallel to one another. FIG. 2D depicts optional end caps 44, 46 disposed on the ends 22, 24 of the inserts 20. Optionally, end caps 44, 46 can give the inserts 20 additional support and provide a more finished or ornamental appearance. Additionally, the end caps 44, 46 can include indicia relating to the orientation or performance characteristics of the inserts 20.

Figure 2E:
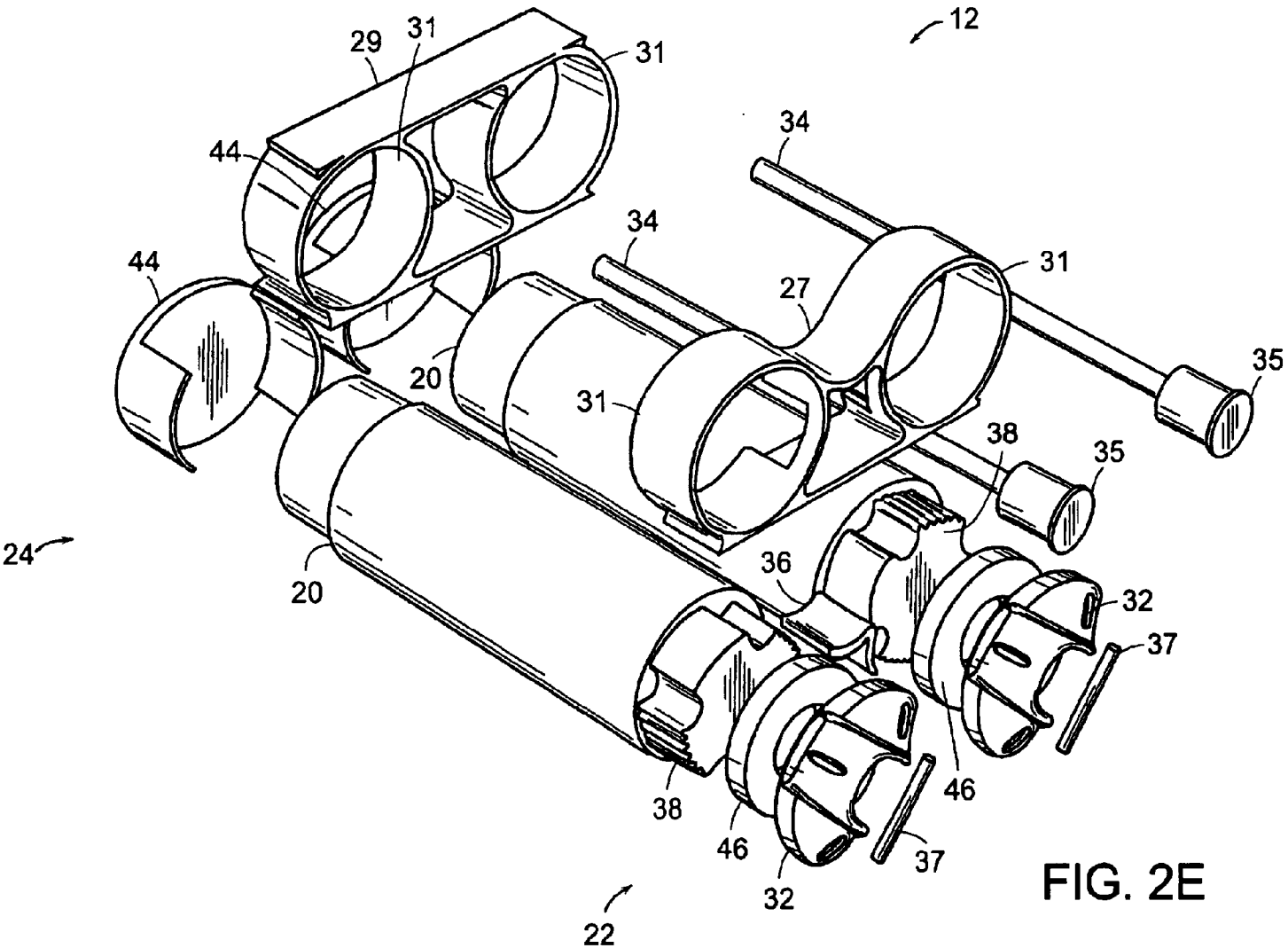
FIG. 2E is an exploded perspective view of the adjustable cushioning system of FIG. 2B.
Figure 2F:
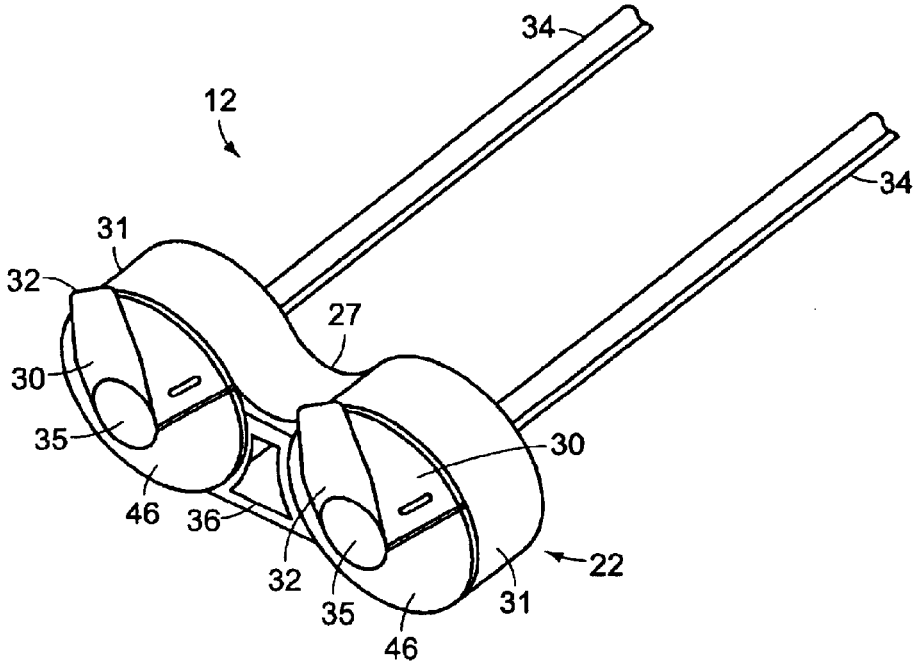
FIG. 2F is a schematic perspective view of a portion of the adjustable cushioning system of FIG. 2B with the inserts removed.

FIG. 2E is an exploded perspective view of the adjustable cushioning system 12. The system 12 includes two inserts 20, end caps 44, 46 disposed on the ends of each insert 20, and casings 27, 29 disposed about the ends of the inserts 20. The casings 27, 29 include retainer rings 31 that circumscribe the ends of the inserts 20. Also depicted proximate the first end 22 of the adjustable cushioning system 12 are the locking mechanisms 30 that include levers 32, pins 37, and shafts 34. The shafts 34 extend substantially along the entire length of the inserts 20 and include hubs 35 disposed on one end for receiving the pins 37 that pivotably couple the levers 32 to the shafts 34. In addition, various components of a positioning mechanism 40 are depicted. The positioning mechanism 40 (FIGS. 5A–5D) includes a detent assembly 36 and two ratchet wheels 38 disposed at the ends of the inserts 20. The positioning mechanism 40 may be sized and configured to assist the locking mechanism 30 to maintain the inserts 20 in predetermined orientations and/or provide tactile and audible feedback to a wearer as to the orientation of the inserts 20. FIG. 2F is a partial perspective view of the adjustable cushioning system 12 without the inserts 20 shown. FIG. 2F depicts the first end 22 including the casing 27, the locking mechanisms 30, and the shafts 34 extending therefrom.

Figure 3A:
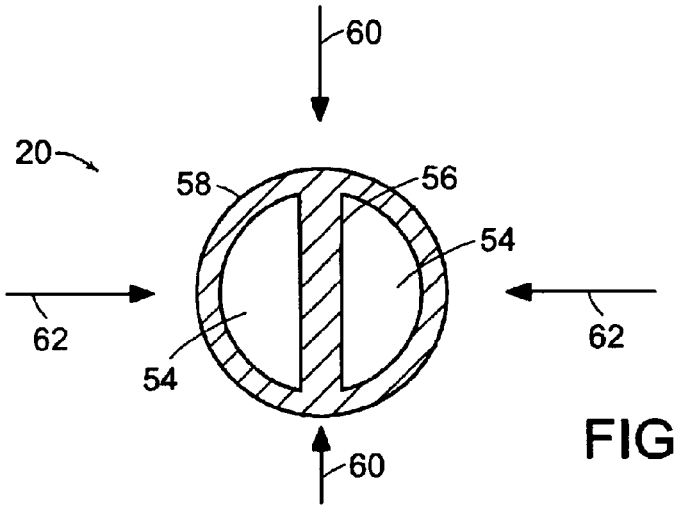
FIGS. 3A–3C are cross-sectional schematic views of various embodiments of one insert of FIG. 2D taken at line 3—3.
Figure 3B:
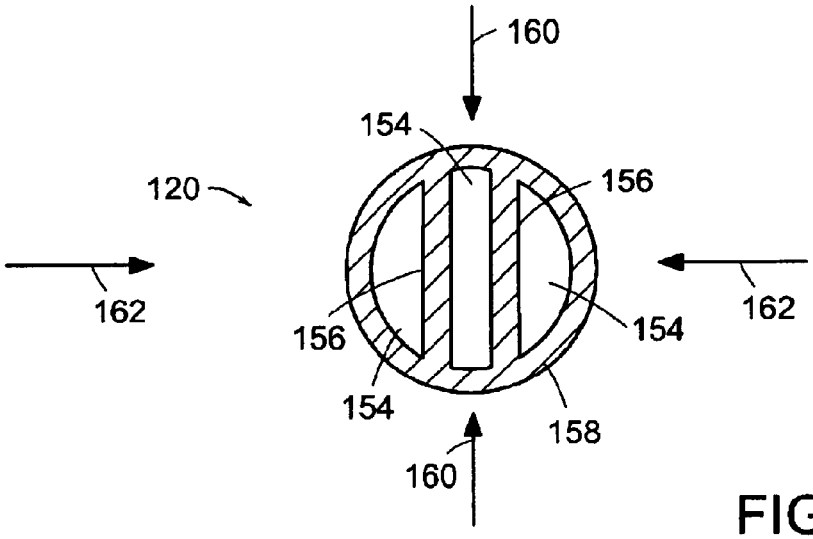
Figure 3C:
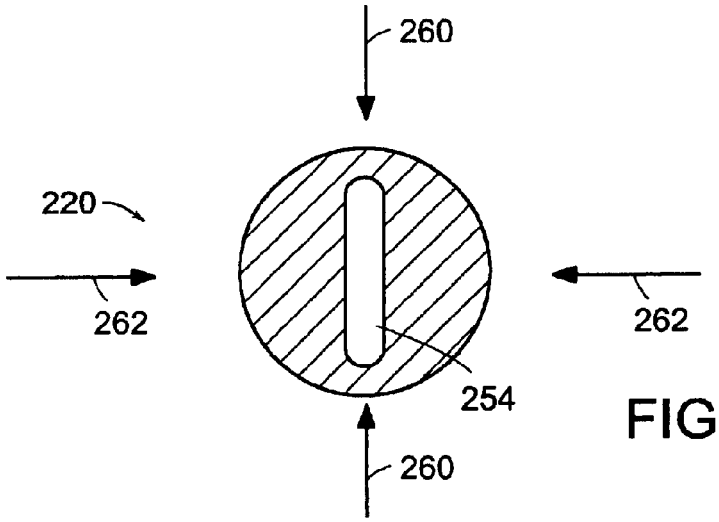

FIGS. 3A–3C are cross-sectional views of various embodiments of the insert 20. FIG. 3A depicts an insert 20 having a generally circular cross-section and an outer wall 58 and a skeletal element 56 defining two apertures 54. The apertures 54 can extend substantially the entire length of the insert 20. The apertures 54 shown have generally arcuate, D-shaped cross-sections; however, the apertures 54 could be essentially any polygonal and/or arcuate shape. Additionally, the apertures 54 could be filled with a foam material. FIG. 3B depicts an alternative embodiment of an insert 120. The insert 120 has a generally circular cross-section and an outer wall 158 and two skeletal elements 156 defining three apertures 154. FIG. 3C depicts another alternative embodiment of an insert 220. The insert 220 has a generally circular cross-sectional shape and is a substantially solid (foamed or non-foamed) piece defining an elongate aperture 254. The apertures 54, 154, 254 and skeletal elements 56, 156 define, at least in part, the anisotropic properties of the inserts 20, 120, 220. The insert 20, 120, 220 is stiffest, i.e. most difficult to compress, when in a vertical orientation (as shown) and provides the softest cushioning, i.e., easiest to compress, when rotated 90 degrees to a horizontal orientation. Specifically, the insert 20, 120, 220 has a greater resistance to a force applied as shown by arrows 60, 160, 260, and thereby a firmer "ride," than when exposed to a force applied as shown by arrows 62, 162, 262. In other words, the insert 20 is firmest in response to a force applied parallel to the skeletal element 56 (arrows 60), as opposed to a force applied perpendicular to the skeletal element 56 (arrows 62).

Figure 4A:
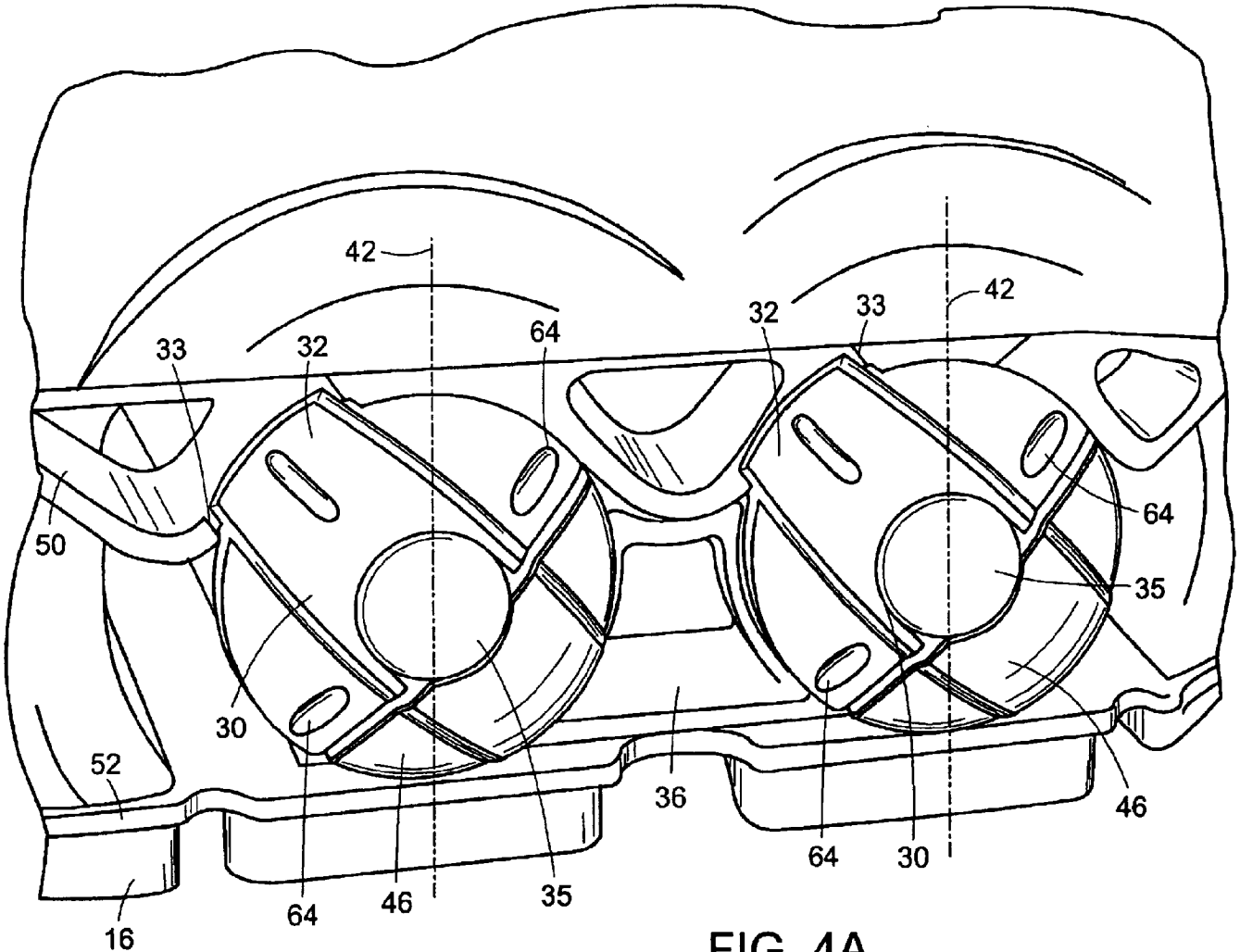
FIG. 4A is a schematic end view of the adjustable cushioning system of FIG. 2B in a locked configuration.
Figure 4B:
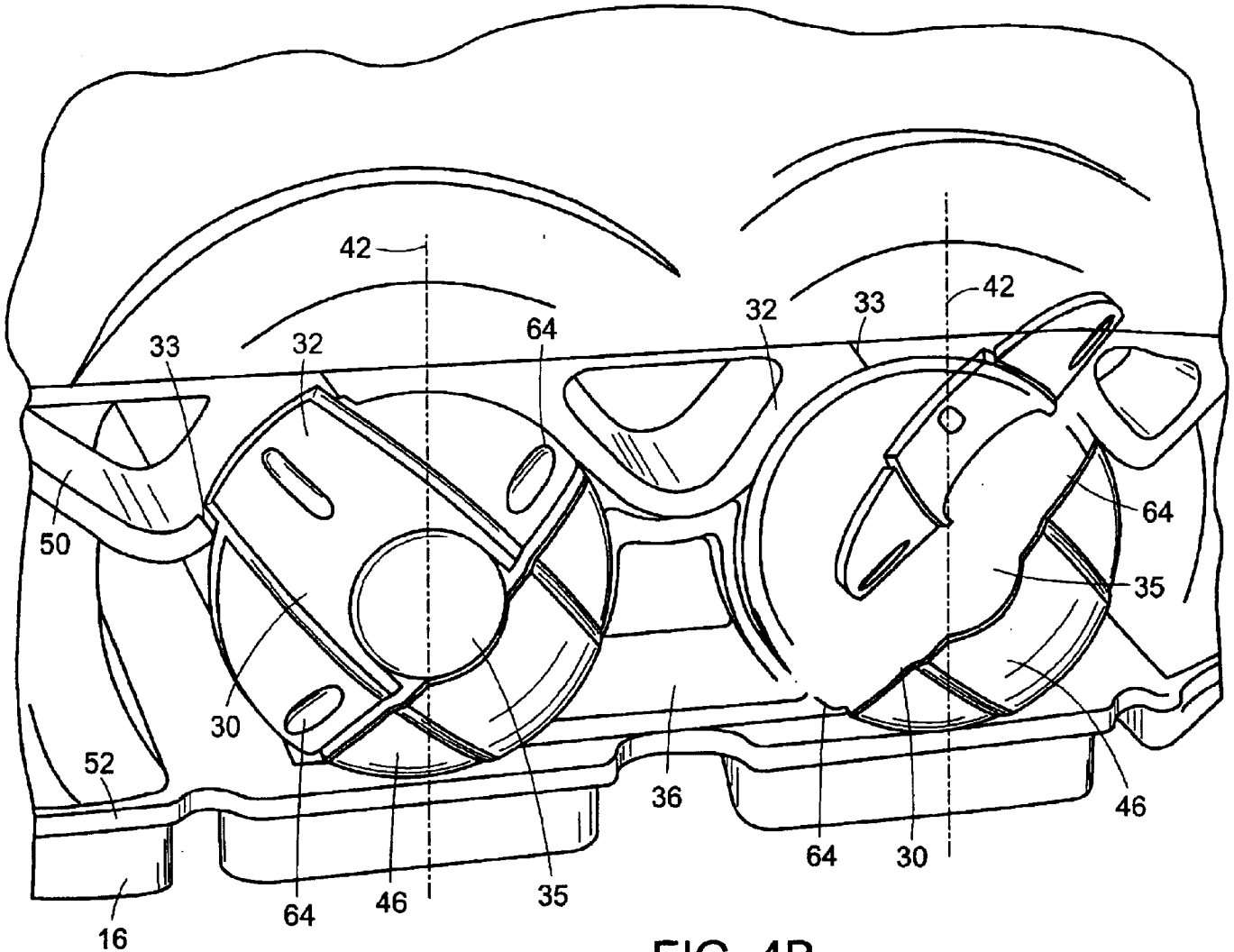
FIG. 4B is a schematic end view of the adjustable cushioning system of FIG. 2B in an unlocked configuration.

FIGS. 4A and 4B depict enlarged side views of the adjustable cushioning system 12 of FIG. 1. FIG. 4A depicts the locking mechanism 30 in a locked position and FIG. 4B depicts the locking mechanism 30 in an unlocked or open position. In the embodiment shown, the locking mechanism 30 has two locked orientations. The first (and shown) orientation is about −45 degrees relative to a vertical axis 42. The second orientation is located at about +45 degrees relative to the vertical axis 42. These two orientations allow for 90 degrees of rotation of the inserts 20 relative to the article of footwear. For example, and with reference to FIGS. 3A–3C, the insert 20 can be rotated to and locked in the vertical position or the horizontal position. Alternatively, the insert 20 could have essentially any number of orientations in which the insert 20 can be locked, as desired.

The locking mechanism 30 depicted is a dual position mechanism configured to provide a toggle function, i.e., the mechanism 30 is stable in either open or closed positions. The lever 32 is coupled to the hub 35 and, correspondingly to the insert 20, by a pin 37. The pin 37 is coupled to the lever 32 via holes 64 disposed in the lever 32. The pin 37 may be held in place by bonding, frictional engagement, or other mechanical means. Other types of actuators and other methods of coupling the lever 32 to the insert 20 are contemplated and within the scope of the invention. The pin 37 may be made of spring steel and may have a slight bend to effect the toggle function of the lever 32.

To unlock and orient the insert 20, the wearer lifts the lever 32 out of the groove 33 to the unlocked position. In the unlocked position, the lever 32 extends outwardly away from the insert 20. The wearer can use the lever 32 as a handle to rotate the hub 35 and shaft 34 into the desired orientation. The insert 20 rotates with the hub 35 and shaft 34. The insert 20 can include an anti-friction coating that can assist the rotation of the insert 20. In the embodiment shown, the grooves 33 are located in the casing 27 corresponding to various predetermined angular orientations of the inserts 20. To lock the insert 20 into the desired orientation, the wearer pivots the lever 32 so as to be generally flush with the sole 16 and into the groove 33. The groove 33 acts as a stop to prevent rotation of the lever 32, thereby preventing the insert 20 from rotating when in the locked position.

FIGS. 5A–5D are perspective views of the positioning mechanism 40. In the embodiment shown, the positioning mechanism 40 is at least partially disposed within the casing 27 located at the first end 22; however, the positioning mechanism 40 could be disposed on either end of the adjustable cushioning system 12. The positioning mechanism 40 includes a detent assembly 36 that is disposed within the casing 27 between the two retainer rings 31. The assembly 36 includes two detents 39, one disposed adjacent each retainer ring 31. The positioning mechanism 40 also includes a ratchet wheel 38 for each insert 20 that provides an audible and physical indication of orientation to the wearer. The positioning mechanism 40 depicted includes two ratchet wheels 38 that are generally circular in cross-section and are disposed generally concentrically with the retainer rings 31 of the casing 27. The ratchet wheel 38 may, in one embodiment, circumscribe an end of the insert 20. The ratchet wheel 38 includes four notches 41 disposed equidistantly about the ratchet wheel 38. The notches 41 correspond to various predetermined orientations of the insert 20 and engage the detents 39 to indicate (audibly and/or physically) to the wearer when the insert 20 is in a desired orientation.

Figure 5A:
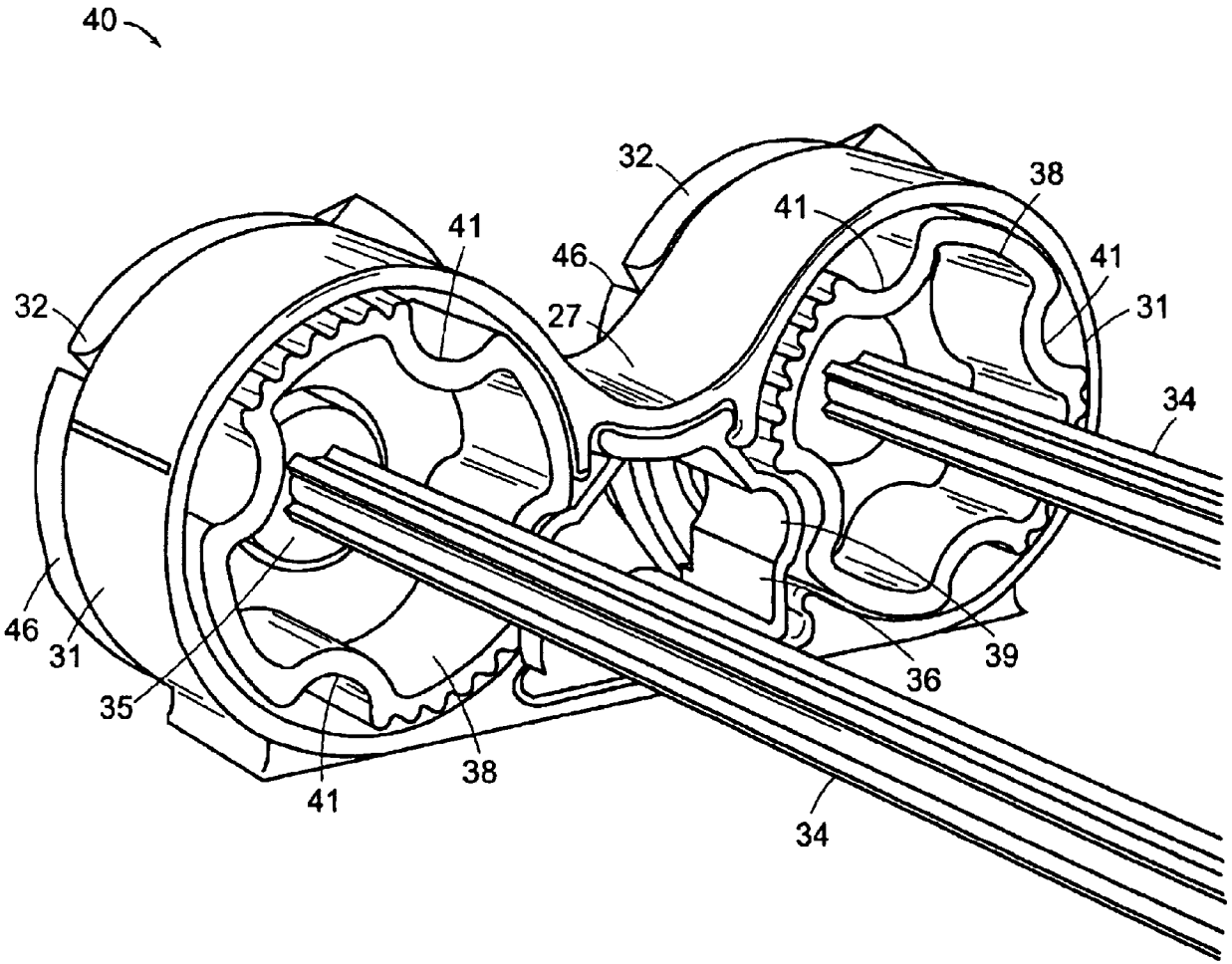
FIG. 5A is a schematic perspective view of a positioning mechanism disposed in the adjustable cushioning system of FIG. 2B, with the inserts removed.
Figure 5B:
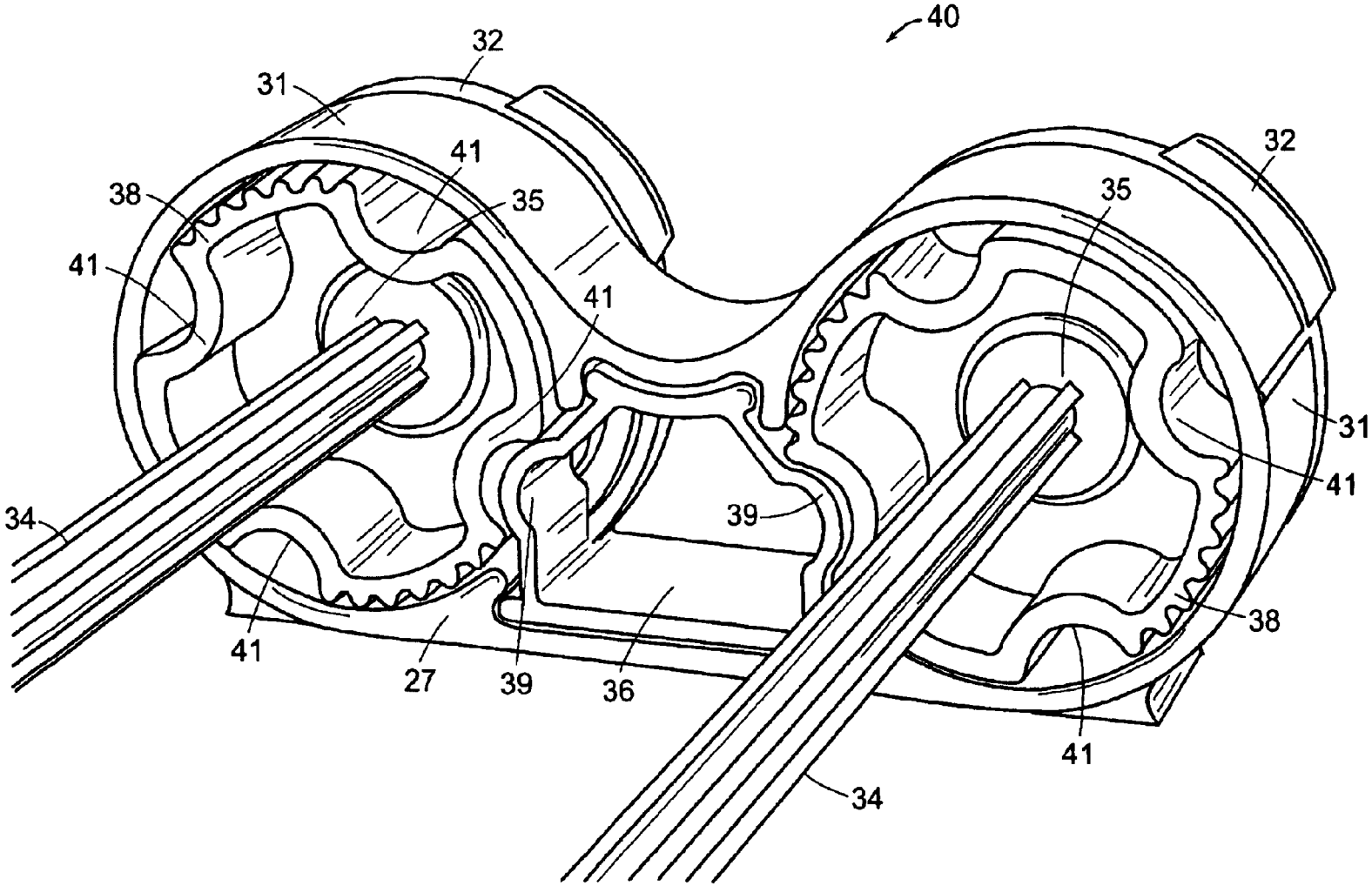
FIG. 5B is another schematic perspective view of the positioning mechanism of FIG. 5A.
Figure 5C:
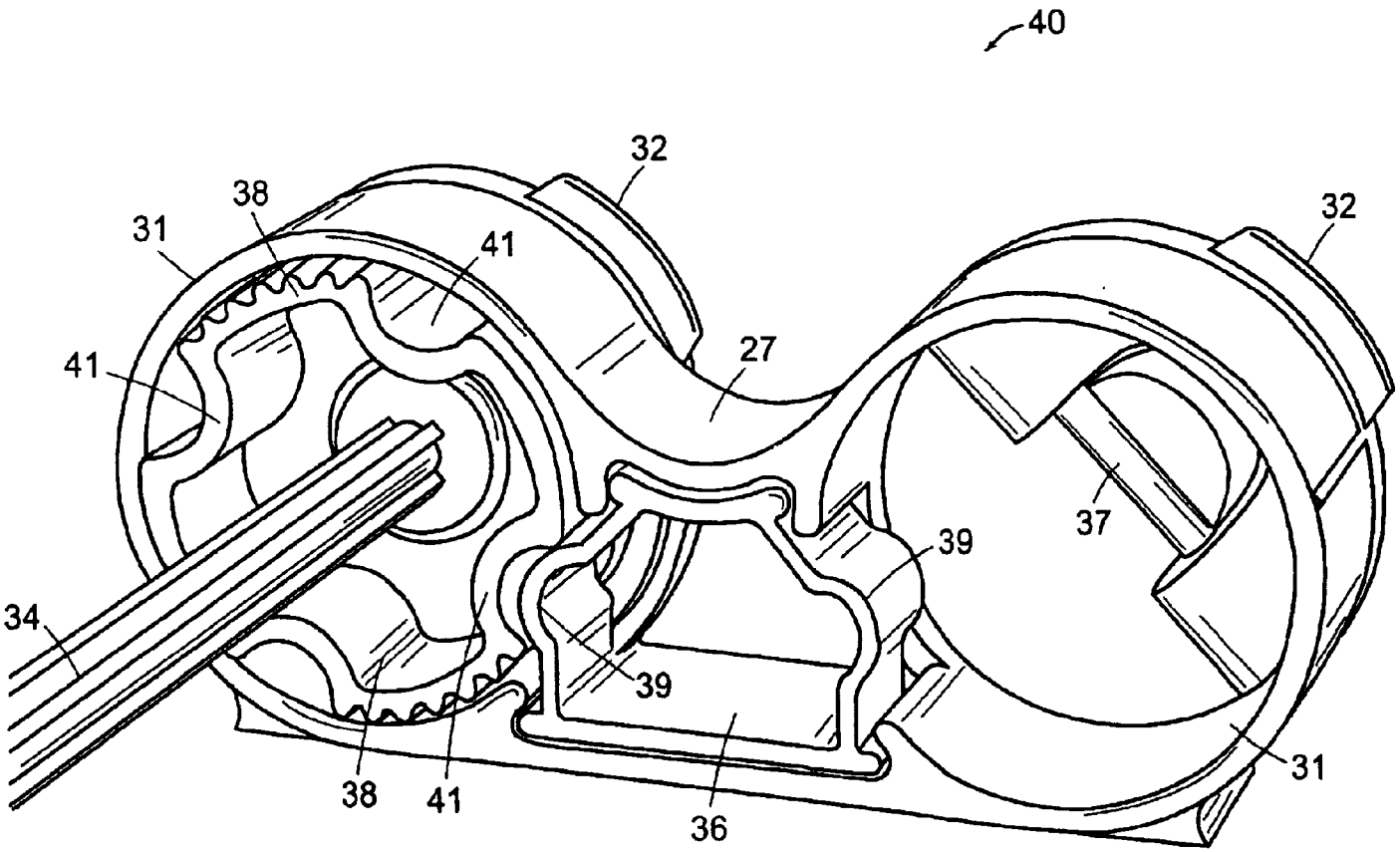
FIG. 5C is another schematic perspective view of the positioning mechanism of FIG. 5A.
Figure 5D:
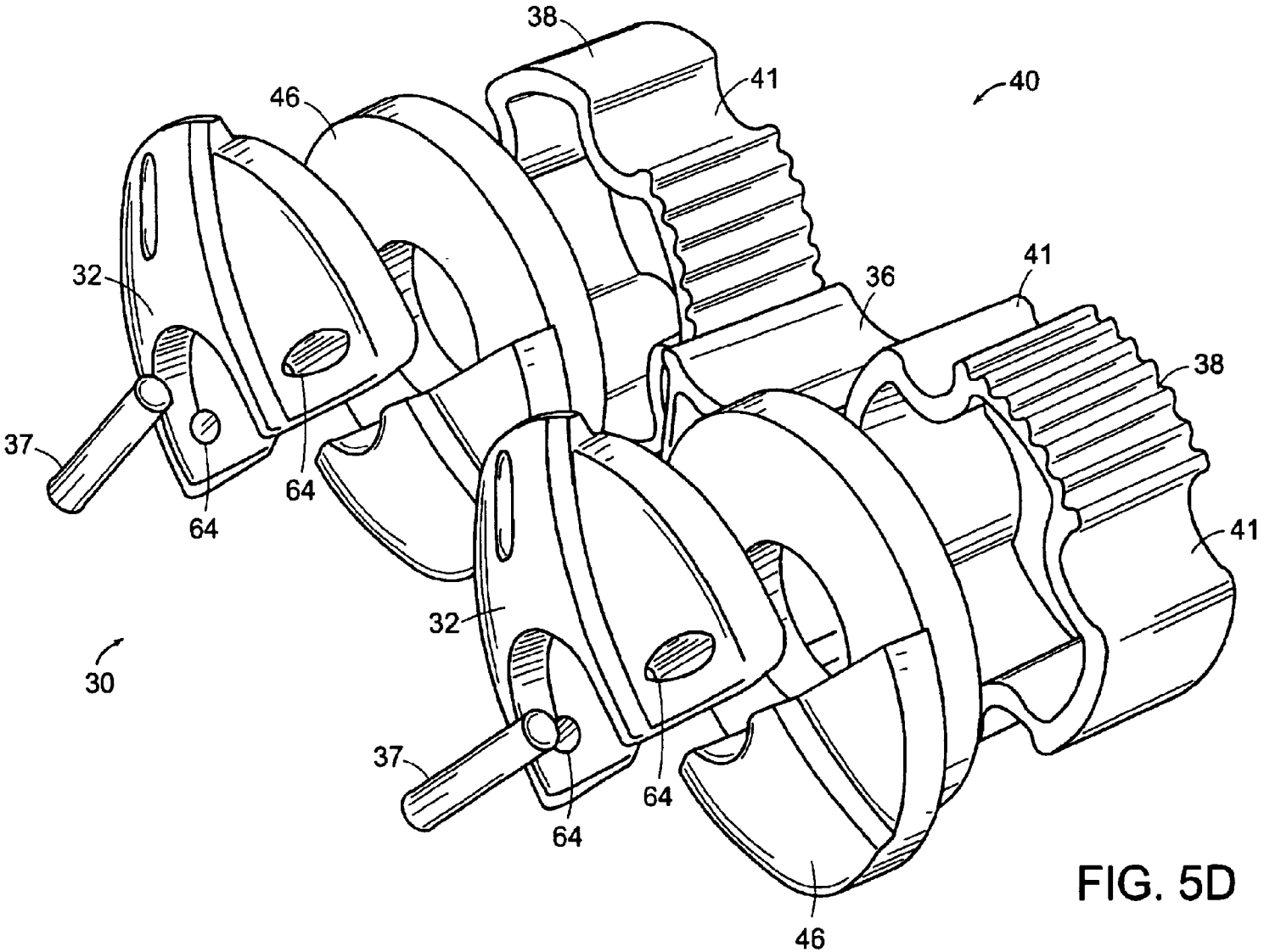
FIG. 5D is a partial exploded perspective view of the locking mechanism of FIG. 4A and the positioning mechanism of FIG. 5A.

FIG. 5C depicts the engagement mechanism assembly 40 with one ratchet wheel 38 removed. It can be seen that the detent 39 extends into the retainer ring 31 of the casing 27. Also shown are the lever 32 and pin 37 components of the locking mechanism 30. FIG. 5D is an exploded view of the components of the locking mechanism 30 and the positioning mechanism 40. The lever 32 is configured to fit substantially flush with the end cap 46. In operation, the ratchet wheel 38 is coupled to the lever 32, such that rotation of the lever 32 and insert 20 causes the ratchet wheel 38 to rotate. The notches 41 engage the detents 39 as the insert 20 and ratchet wheel 38 rotate. Once the wearer has reached the desired orientation, as indicated by the audible and/or tactile feedback of the positioning mechanism 40, the wearer can return the lever 32 to the locked position. In an alternative embodiment, the positioning mechanism 40 and the locking mechanism 30 can be located on opposite ends of the adjustable cushioning system 12. For example, the locking mechanism 30 can be located on the medial side of a shoe and the positioning mechanism 40 can be located on the lateral side of the shoe.

Figure 6A:
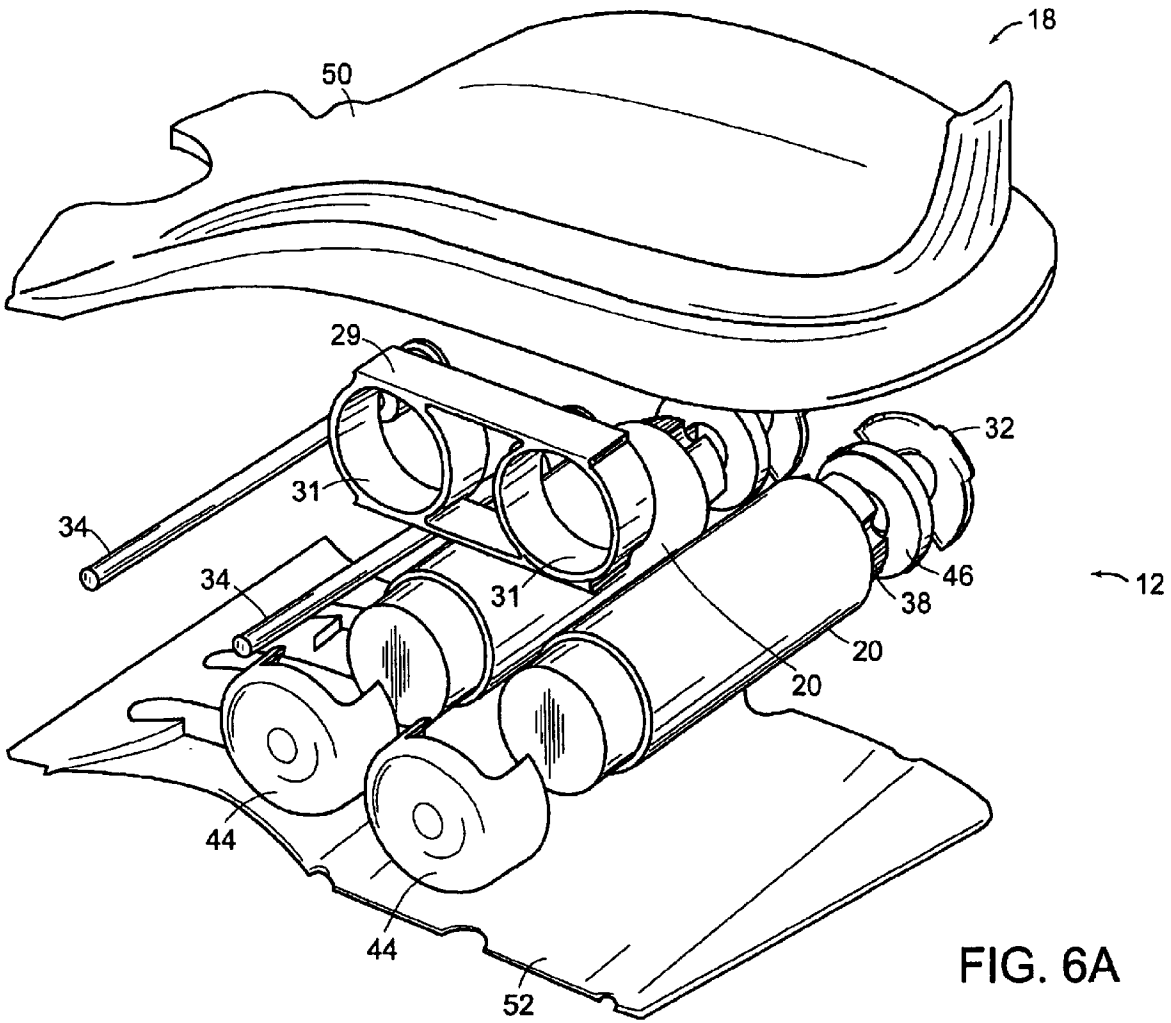
FIG. 6A is a partial exploded view of a lateral side of a heel assembly including the adjustable cushioning system of FIG. 2B.
Figure 6B:
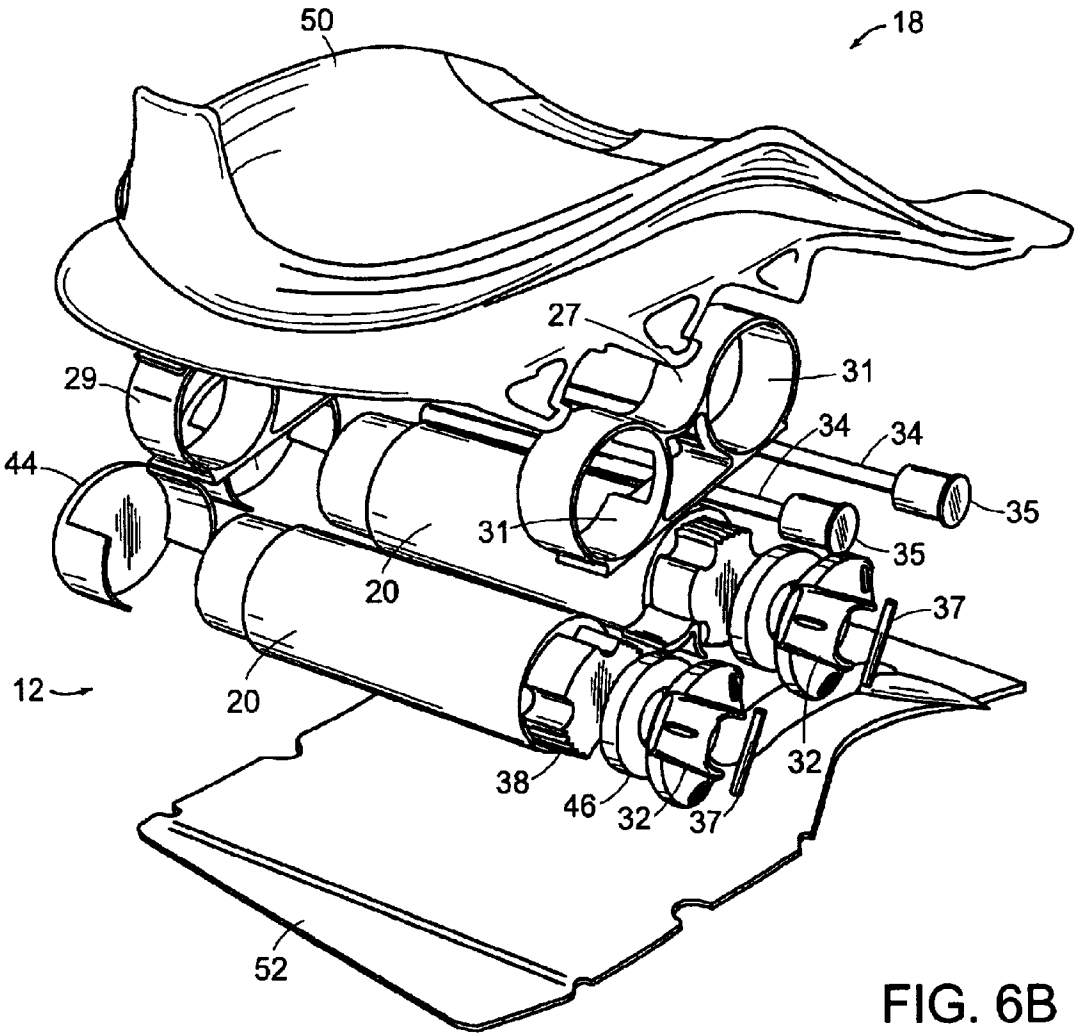
FIG. 6B is a partial exploded view of the medial side of the heel assembly of FIG. 6A.

FIGS. 6A and 6B depict partially exploded views of the heel 18 of FIG. 1, as seen from the lateral side and the medial side, respectively. In one embodiment, the adjustable cushioning system 12 is disposed between an upper plate 50 and a lower plate 52. The upper plate 50 and the lower plate 52 may provide structural support and stability for the article of footwear 10 and may house and protect the adjustable cushioning system 12. The plates 50, 52, in one embodiment, may be coupled forward of the adjustable cushioning system 12 (see FIG. 1). Coupling the plates 50, 52 can provide greater structural stability to the article of footwear and can create a tunnel torsion element 66 in the shank area 68 (FIG. 1) of the sole 16. The plates 50, 52 can form a single, recumbent V or U-shaped housing. The upper plate 50 may include a heel counter formed in a top surface thereof and/or projections on a bottom surface thereof that engage at least one of the casings 27, 29. The lower plate 52 can lock the inserts 20 and system 12 in place relative to the sole 16. Additionally, because the lower plate 52 can provide structural support to the article of footwear, less material may be necessary for the outsole. For example, the lower plate 52 can be insert injection molded with one or more rubber outsole elements. Additionally, the lower plate 52 can be transparent to allow a wearer visual access to the adjustable cushioning system 12.

Figure 7:
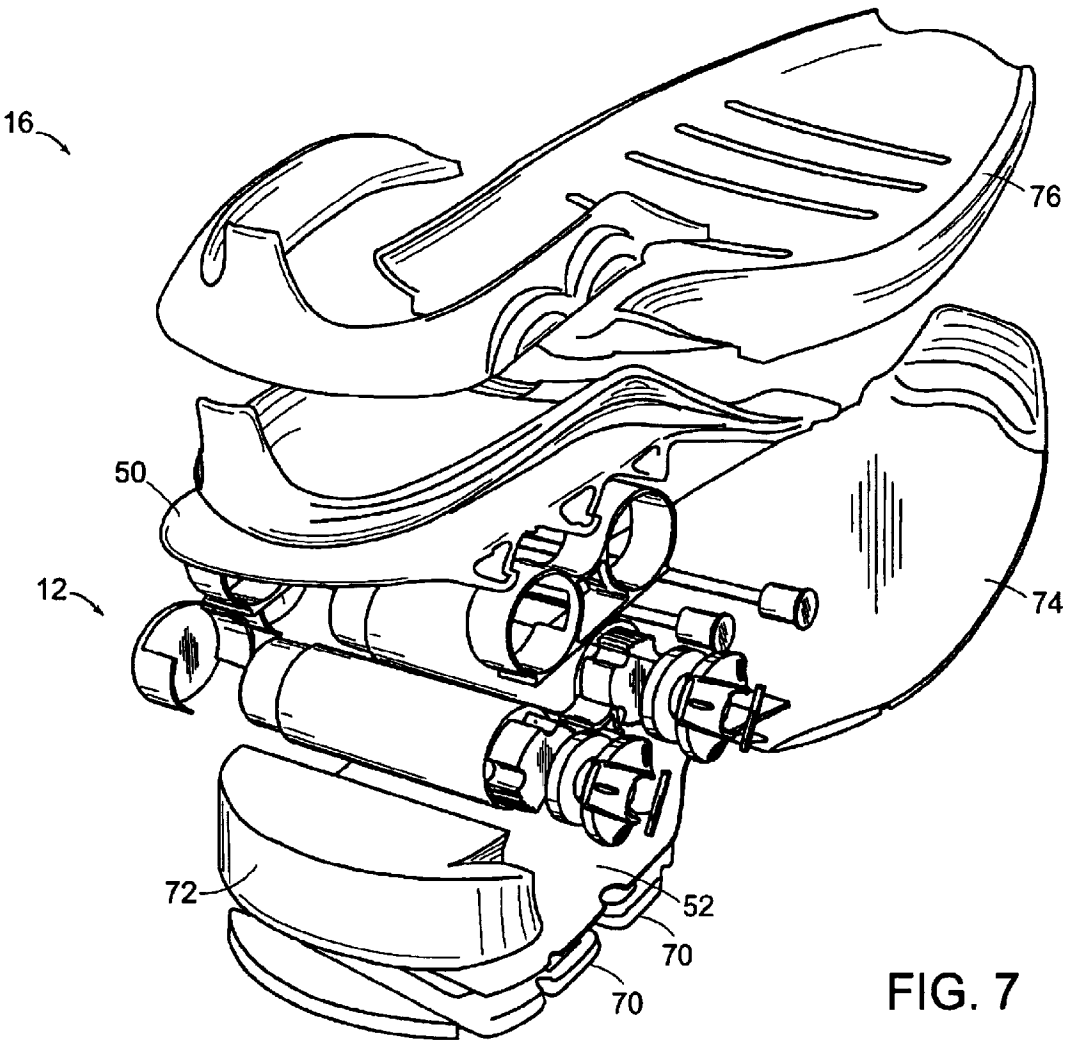
FIG. 7 is an exploded perspective view of the sole of FIG. 1 including the adjustable cushioning system of FIG. 2B.

FIG. 7 depicts the sole 16 of FIG. 1. In addition to the adjustable cushioning system 12 and plates 50, 52 described hereinabove, the sole 16 can include heel outsole elements 70, a forefoot outsole 74, a heel strike cushioning element 72, and a midsole 76.

Figure 8A:
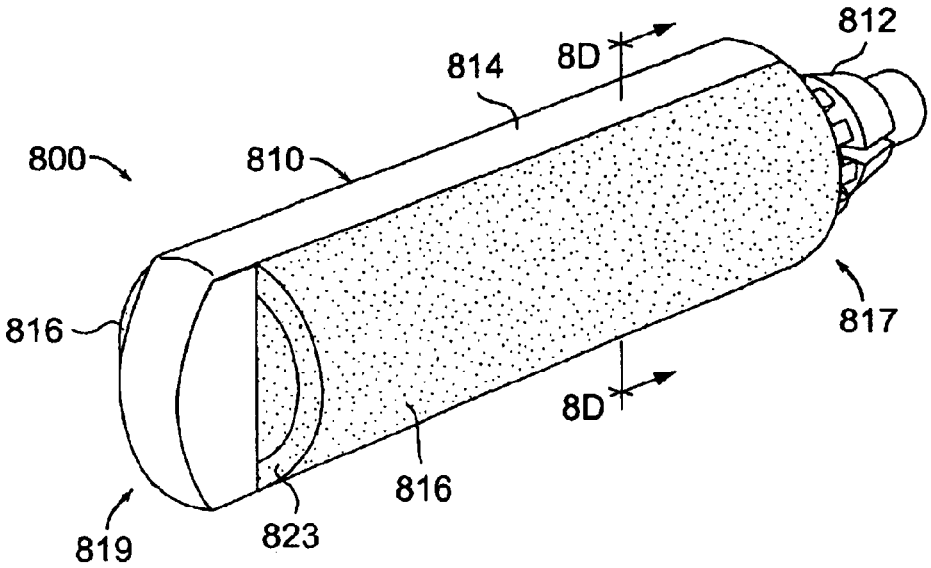
FIG. 8A is a schematic perspective view of an alternative embodiment of an insert in accordance with the invention.

FIGS. 8A–8D depict an alternative embodiment of an adjustable cushioning system 800 in accordance with the invention. The adjustable cushioning system 800 includes one or more inserts 810. FIG. 8A is a perspective schematic view of the insert 810 including an end cap 812, an internal support 814, and an external cushioning element 816. The insert 810 has a dual density construction, where the internal support 814 and external cushioning element 816 are manufactured from materials of differing durometer. The term "dual density" is used herein according to its ordinary meaning, e.g., the insert includes two materials of differing density. The term dual density is, however, also used to cover an insert comprising a single material surrounding a void(s), such that the insert exhibits anisotropic characteristics.

The internal support 814 extends axially from the end cap 812 and the external cushioning element 816 is disposed about at least a portion of the internal support 814. The insert 810 has a generally cylindrical shape in the embodiment shown; however, the shape can be chosen to suit any particular application.

The end cap 812 (FIG. 8C) is optional and can be disposed at either one and/or both ends of the insert 810. As shown, the end cap 812 is disposed at the proximal end 817 of the insert 810. The end cap 812 is substantially cylindrical in shape. The end cap 812 has a lip 813 that defines a recess 815. The end cap 812 can function as structural support for the insert 810 and/or serve an aesthetic purpose. For example, the end cap 812 can be used as a handle to rotate and/or remove the insert 810 from an article of footwear. In addition, the end cap 812 could include a locking mechanism to hold the insert 810 in place within the article of footwear. The end cap 812 can also include indicia on an outer surface thereof that indicates the orientation of the insert 810 within the article of footwear.

Figure 8B:
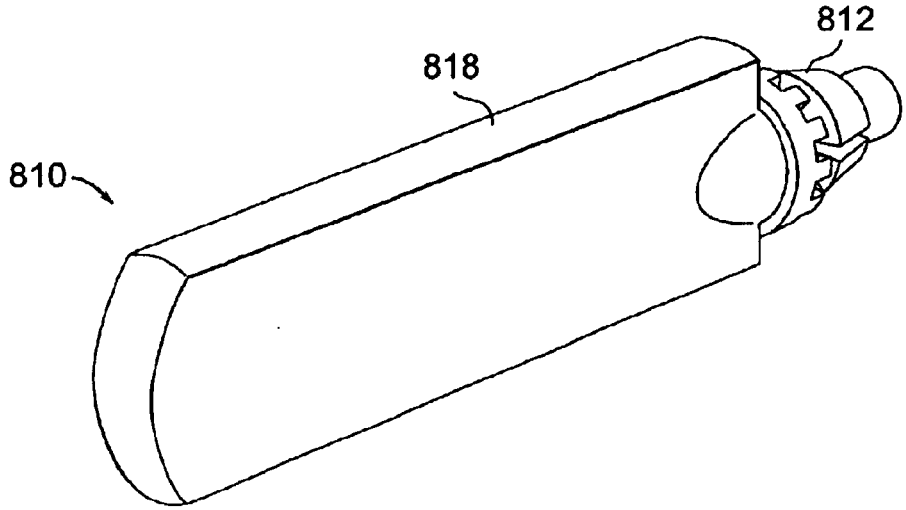
FIG. 8B is another schematic perspective view of the insert of FIG. 8A, without an external cushioning element.
Figure 8C:
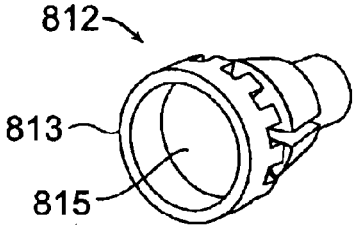
FIG. 8C is a schematic perspective view of an end cap for use with the insert of FIGS. 8A and 8B.

FIG. 8B is a perspective schematic view of the end cap 812 and internal support 814 extending axially therefrom. The internal support 814 is coupled to the end cap 812 by frictional engagement and/or an interference fit. Alternatively, the internal support 814 may be held in place by adhesive bonding, solvent bonding, mechanical retention, or similar techniques. Typically, the internal support 814 fills the recess 815 and may be bonded to the lip 813 and/or the recess 815. Alternatively, the internal support 814 is not coupled to the end cap 812. The internal support 814 can have a cross-sectional shape, such as polygonal, arcuate, or combinations thereof. In the embodiment shown in FIG. 8B, the internal support 814 is substantially rectangular in shape and extends the entire length and width of the insert 810. Typically, the internal support 814 is made of a high durometer dense foam or a substantially rigid material. Generally, the internal support 814 is made of a harder material than the external cushioning element 816.

The external cushioning element 816 is shown as two separate pieces, one disposed on each side of the internal support 814; however, the external cushioning element 816 can be a single piece that completely surrounds the internal support 814. The external cushioning element 816 is affixed to the internal support 814 by adhesive bonding, solvent bonding, mechanical retention, or similar techniques. The external cushioning element 816 extends from the cap 812 and has a length that is slightly less than the length of the internal support 814. The external cushioning element 816, however, can extend the entire length of the internal support 814 or be longer than the internal support 814. The external cushioning element 816 shown has a chamfer 823 disposed at its distal end 819. Typically, the external cushioning element 816 is made of a soft foam and has a durometer less than that of the internal support 814.

Figure 8D:
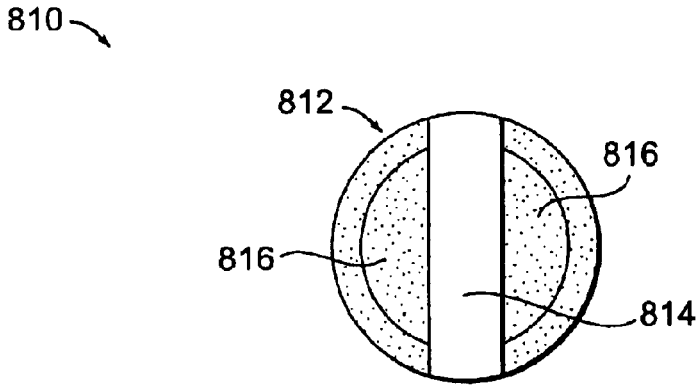
FIG. 8D is cross-sectional schematic view of the insert of FIG. 8A taken at line 8D—8D.

FIG. 8D is a cross-sectional schematic view of the insert 810 of FIG. 8A taken at line 8D—8D. The insert 810 has a generally circular cross-section while the internal support 814 has a generally rectangular cross-section and spans substantially the entire width of the insert 810. The external cushioning element 816 is disposed on both sides of the internal support 814.

Figure 8E:
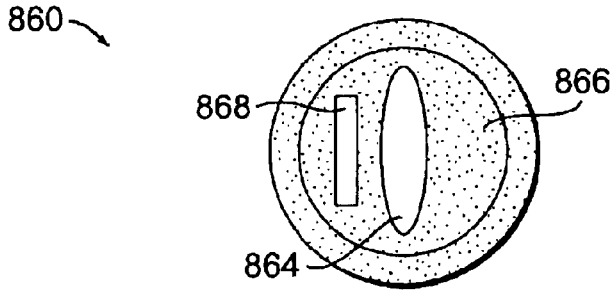
FIG. 8E is a cross-sectional schematic view of an alternative embodiment of an insert in accordance with the invention.
Figure 8F:
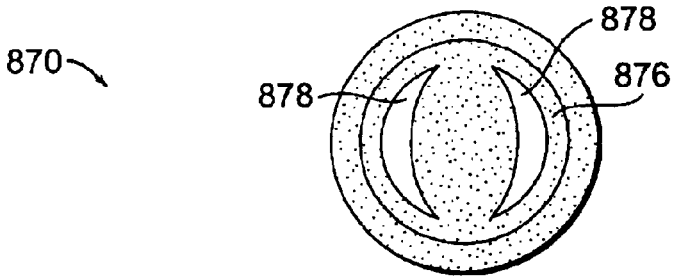
FIG. 8F is a cross-sectional schematic view of another alternative embodiment of an insert in accordance with the invention.

FIGS. 8E and 8F depict schematic cross-sectional views of alternative inserts 860, 870. In FIG. 8E, the internal support 864 has an elliptical cross-sectional shape and the external cushioning element 866 surrounds the internal support 864. The external cushioning element 866 also includes an aperture 868 located on one side of the internal support 864. The aperture 868 can extend substantially the entire length of the external cushioning element 866 and can run generally parallel to the internal support 864. The aperture 868 shown has a generally rectangular cross-sectional shape; however, the aperture 868 could be essentially any polygonal and/or arcuate shape. Alternatively, a second aperture 868 could be located on the other side of the internal support 864. In FIG. 8F, the internal support has been removed. The external cushioning element 876 has two apertures 878 generally longitudinally disposed therein. The apertures 878 are "crescent" shaped and run generally parallel to the external cushioning element 876. Alternatively, the apertures 878 could be "kidney" shaped. In this embodiment, the insert 870 is stiffest, i.e. most difficult to compress, when in the vertical orientation shown in FIG. 8F. The insert 870 provides the softest cushioning, i.e., easiest to compress, when rotated 90 degrees so that the apertures 878 are oriented one above the other.

Figure 9A:
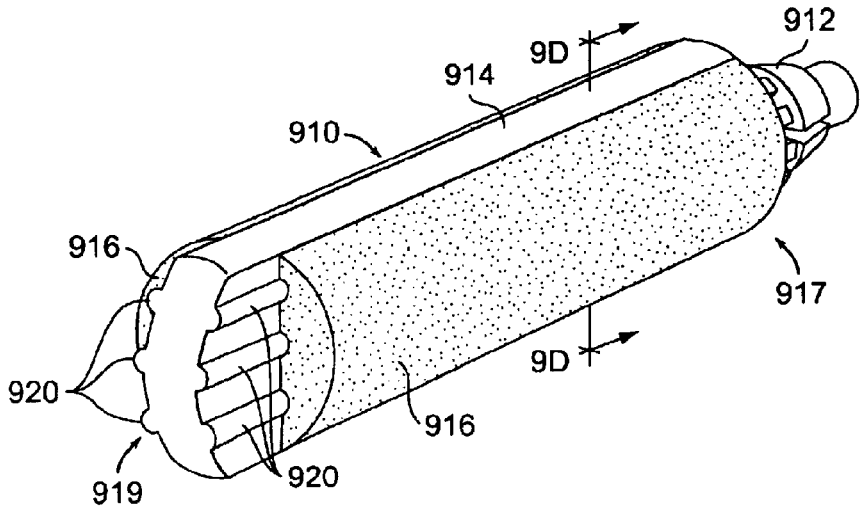
FIG. 9A is a schematic perspective view of another alternative embodiment of an insert in accordance with the invention.
Figure 9B:
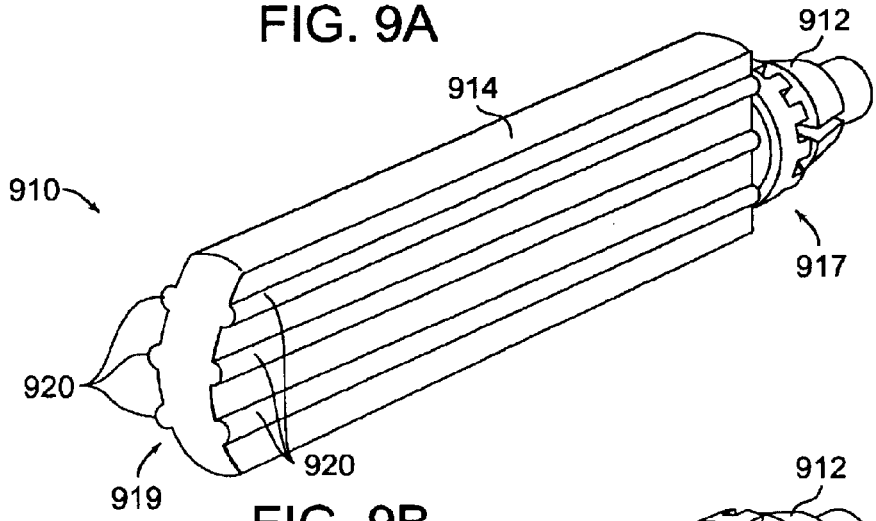
FIG. 9B is another schematic perspective view of the insert of FIG. 9A, without an external cushioning element.
Figure 9C:
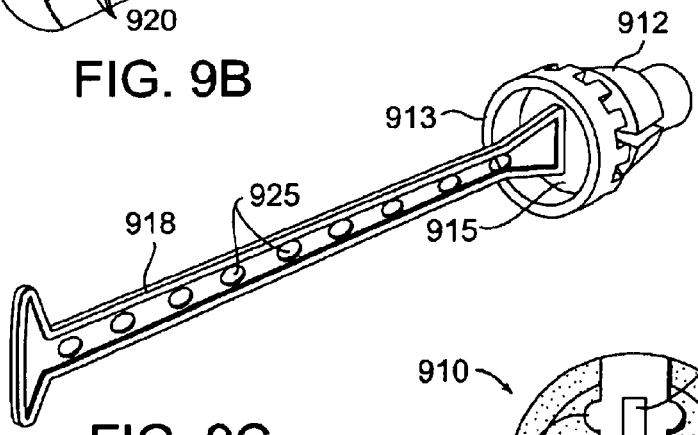
FIG. 9C is a schematic perspective view of an end cap and axle for use with the insert of FIGS. 9A and 9B.

FIGS. 9A–9C are perspective schematic views of an alternative insert design. The size, shape, and material choices for the insert 910 and its various components are essentially the same as those discussed above with respect to FIGS. 8A–8D. The insert 910 includes an end cap 912, an internal support 914, an external cushioning element 916, and an axle 918. The axle 918 is bonded to the end cap 912 and extends axially therefrom. Alternatively, the axle 918 could be integrally formed with the end cap 912. The axle 918 is a generally thin, elongate element that adds stiffness to the internal support 914. The axle 918 can include one or more apertures 925 disposed along its length to reduce weight. The size, shape, and number of apertures can be varied to suit a particular application. The internal support 914 is disposed about the axle 918. In the embodiment shown, the internal support 914 is supported by the axle 918 and does not contact the end cap 912. The internal support 914 has a series of three ribs 920 disposed on each side thereof.

Figure 9D:
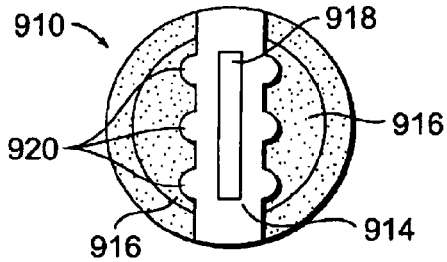
FIG. 9D is cross-sectional schematic view of the insert of FIG. 9A taken at line 9D—9D.

FIG. 9D is a cross-sectional schematic view of the insert 910 of FIG. 9A taken at line 9D—9D. The insert 910 has a generally circular cross-section while the internal support 914 has a generally rectangular cross-section and spans substantially the entire width of the insert 910. The internal support 914 surrounds the axle 918 and includes three ribs 920 disposed equidistantly on each side of the internal support 914. The ribs 920 are generally arcuate in shape. The number, shape, size, and placement of the ribs 920 can be varied to suit a particular application. The external cushioning element 916 includes two pieces, with one piece disposed on each side of the internal support 914. As discussed above with respect to FIGS. 8E and 8F, the external cushioning element 916 can include one or more apertures disposed therein.

The various components of the adjustable cushioning systems described herein can be manufactured by, for example, injection molding or extrusion and optionally a combination of subsequent machining operations. Extrusion processes may be used to provide a uniform shape, such as a single monolithic frame. Insert molding can then be used to provide the desired geometry of the open spaces, or the open spaces could be created in the desired locations by a subsequent machining operation. Other manufacturing techniques include melting or bonding additional portions. For example, the internal walls or skeletal elements 56, 156 may be adhered to the insert 20, 120 with a liquid epoxy or a hot melt adhesive, such as ethylene vinyl acetate (EVA). In addition to adhesive bonding, components can be solvent bonded, which entails using a solvent to facilitate fusing of various components. In another example, the end cap 912 could be fused to the internal support 914 during a foaming process, or could be integrally formed with the axle 918.

The various components can be manufactured from any suitable polymeric material or combination of polymeric materials, either with or without reinforcement. Suitable materials include: polyurethanes, such as a thermoplastic polyurethane (TPU); EVA; thermoplastic polyether block amides, such as the Pebax® brand sold by Elf Atochem; thermoplastic polyester elastomers, such as the Hytrel® brand sold by DuPont; thermoplastic elastomers, such as the Santoprene® brand sold by Advanced Elastomer Systems, L.P.; thermoplastic olefin; nylons, such as nylon 12, which may include 10 to 30 percent or more glass fiber reinforcement; silicones; polyethylenes; acetal; and equivalent materials. Reinforcement, if used, may be by inclusion of glass or carbon graphite fibers or para-aramid fibers, such as the Kevlar® brand sold by DuPont, or other similar method. Also, the polymeric materials may be used in combination with other materials, for example rubber. Other suitable materials will be apparent to those skilled in the art.

The insert 20 can be made of one or more various density foams, non-foamed polymer materials, and/or skeletal elements. In an optional embodiment, an external surface 21 of the insert 20 may be coated with an anti-friction coating, such as a paint including Teflon® material sold by DuPont or a similar substance. The insert 20 can be color coded to indicate to a wearer the specific performance characteristics of the insert 20. The size and shape of the insert 20 and the casings 26, 28 can vary to suit a particular application. The inserts can be about 10 mm to about 40 mm in diameter, preferably about 20 mm to about 30 mm, and more preferably about 25 mm. The length of the insert 20 can be about 50 mm to about 100 mm, preferably about 75 mm to about 90 mm, and more preferably 85 mm. The casings 26, 27, 28, 29 can be about 5 mm to about 20 mm deep, preferably about 8 mm to about 12 mm, and more preferably about 10 mm. The inside diameter of the retainer rings 31 is about 10 mm to about 40 mm, preferably about 20 mm to about 30 mm, and more preferably about 25 mm.

In addition, the insert 810 can be integrally formed by a process called reverse injection, in which the external cushioning element 816 itself forms the mold for the internal support 814. Such a process can be more economical than conventional manufacturing methods, because a separate internal support 814 mold is not required. The insert 810 can also be formed in a single step called dual injection, where two or more materials of differing densities are injected simultaneously to create integrally the external cushioning element 816 and the internal support 814. The materials chosen for the various insert components should be "compatible," such that the various components are able to chemically bond to each other at discrete mating locations. In various embodiments, the insert 20 could be a dual density polyurethane foam (40 and 75 asker Shore C hardnesses) or an extruded thermoplastic olefin, for example. The casings 26, 27, 28, 29 could be made of Pebax and the plates 50, 52 could be injection molded TPU.

Figure 10A:
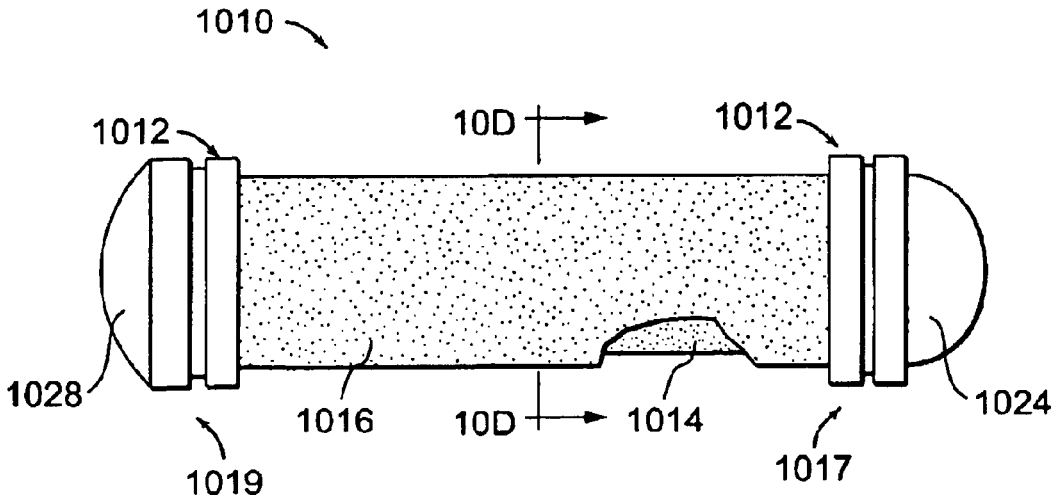
FIG. 10A is a schematic front view of an alternative embodiment of an adjustable cushioning system in accordance with the invention.
Figure 10B:
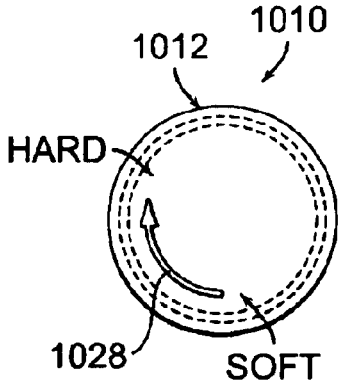
FIG. 10B is a schematic left side view of the adjustable cushioning system of FIG. 10A.
Figure 10C:
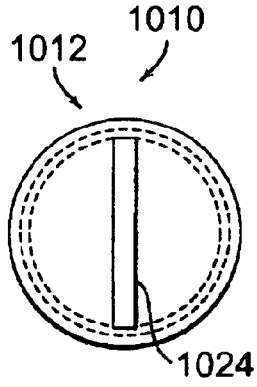
FIG. 10C is a schematic right side view of the insert of FIG. 10A.
Figure 10D:
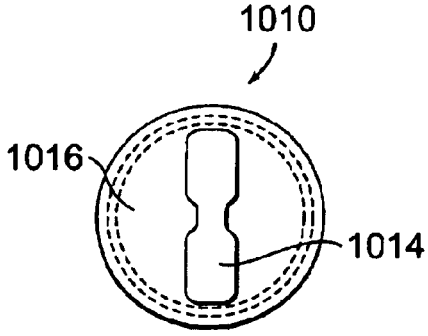
FIG. 10D is a cross-sectional schematic view of the insert of FIG. 10A taken at line 10D—10D.

FIGS. 10A–10D depict another alternative embodiment of an insert 1010 in accordance with the invention. The insert 1010 includes two optional end caps 1012 and an internal support 1014 surrounded by an external cushioning element 1016. The end cap 1012 located at the distal end 1019 of the insert 1010 includes an orientation indicator 1028 disposed thereon. The indicator 1028 (FIG. 10B) can be formed in the end cap 1012 or can be indicia printed on the end cap 1012 that indicates to the wearer the orientation of the insert 1010 within the article of footwear. In an alternative embodiment, the end cap 1012 could include a locking mechanism to hold the insert 1010 in place within the article of footwear. A semi-circular handle 1024 (FIG. 10C) is located on the proximal end 1017 of the insert 1010. The handle 1024 can be formed as part of the end cap 1012 or can be mechanically coupled to the end cap 1012. Alternatively, the handle 1024 can be integrally formed or coupled to the internal support 1014 and/or external cushioning element 1016 and can pass through an opening in the end cap 1012. In a particular embodiment, the handle 1024 is an extension of the internal support 1014 and there is no end cap 1012 disposed on the proximal end 1017 of the insert 1010. The handle 1024 can be used by the wearer to rotationally orient the insert 1010 within the article of footwear and/or remove the insert 1010 from the article of footwear. In alternative embodiments, the handle 1024 and orientation indicator 1028 can be located on the same end of the insert 1010. In one embodiment, the handle 1024 can form at least a portion of the orientation indicator 1028. In addition, the insert 1010 and/or end caps 1012 can be visible to an observer and can indicate to the observer what type of insert 1010 is installed in the footwear. Also, the insert 1010 and/or end caps 1012 can have decorative features. As shown in FIG. 10D, the insert 1010 has a generally circular cross-section and the internal support 1014 has a cross-section including polygonal and arcuate elements. The external cushioning element 1016 surrounds the internal support 1014.

Figure 11A:
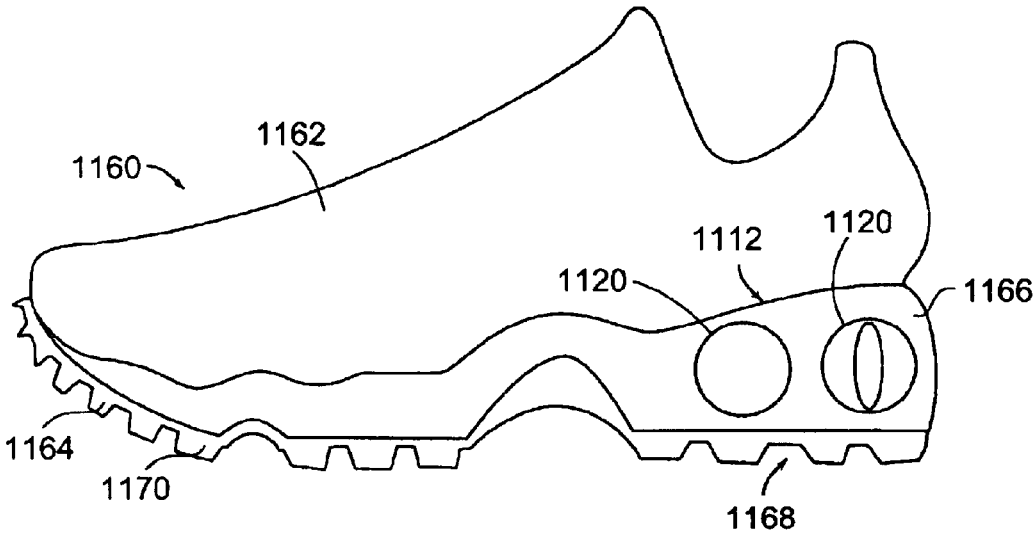
FIG. 11A is a schematic view of an article of footwear including an embodiment of an adjustable cushioning system in accordance with the invention disposed within a sole.
Figure 11B:
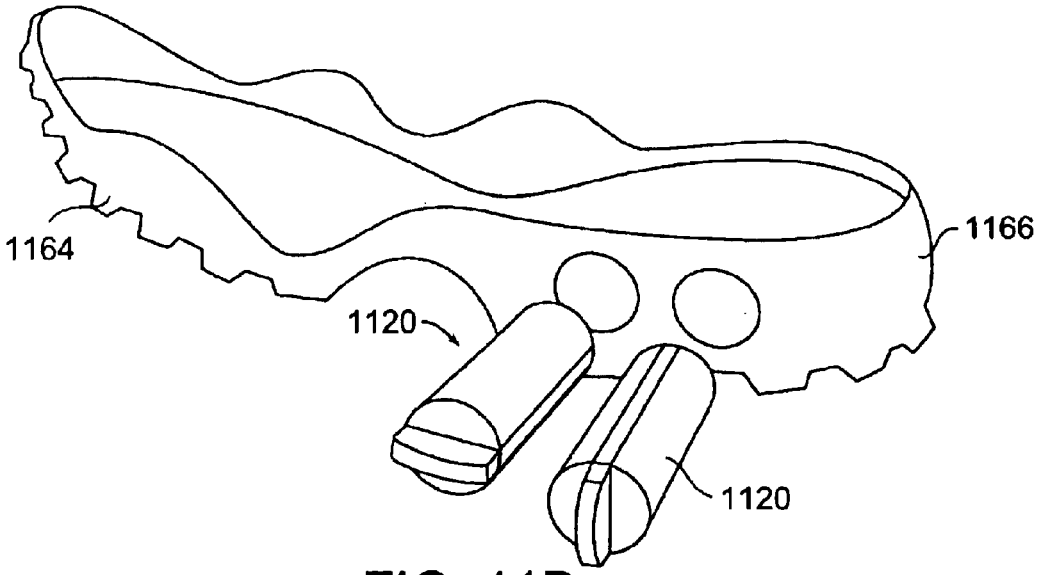
FIG. 11B is a partially exploded perspective view of the sole and adjustable cushioning system of FIG. 11A.

FIGS. 11A and 11B depict an article of footwear 1160 including an upper 1162, a sole 1164, and an adjustable cushioning system 1112 in accordance with the invention. FIG. 11A is a schematic side view of the article of footwear 1160. The adjustable cushioning system 1112 includes two inserts 1120 generally laterally disposed in a heel region 1168 of the sole 1164. The inserts 1120 can span substantially the entire width of the article of footwear 1160. In one embodiment, the sole 1164 can include an outsole 1170 and a midsole 1166, and the system 1112 can be disposed at least partially within the midsole 1166. Typically, the inserts 1120 are laterally disposed within the article of footwear 1160 for running and to adjust the roll of the footwear 1160.

FIG. 11B is a perspective schematic view of the sole 1164 of the article of footwear 1160 of FIG. 11A with the inserts 1120 removed. The inserts 1120 could be any of the types described hereinabove. The inserts 1120 are shown in different orientations. As will be discussed later with respect to FIGS. 14A–14F, the orientation of the insert 1120 affects the performance characteristics of the article of footwear 1160. The insert 1120 is coupled to the article of footwear 1160 by frictional engagement and/or interference fit. Other ways of coupling the insert 1120 to the article of footwear 1160 are possible, as long as the insert 1120 maintains a secure, but rotatable fit within the article of footwear 1160.

Figure 12:
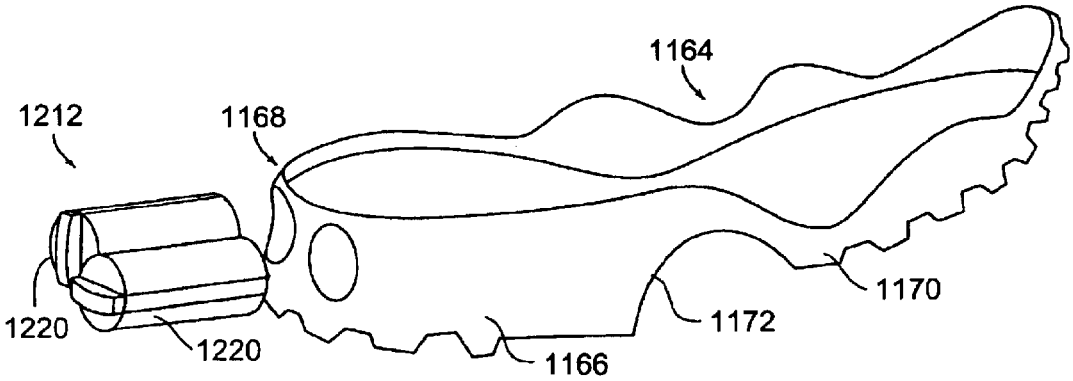
FIG. 12 is a partially exploded perspective view of the sole of FIG. 11B including another embodiment of an adjustable cushioning system in accordance with the invention.

FIG. 12 depicts an alternative embodiment of an adjustable cushioning system 1212 disposed in the sole 1164 of FIG. 11B. The adjustable cushioning system 1212 is shown removed and includes two inserts 1220 generally longitudinally disposed in a heel region 1168 of the sole 1164. Typically, the inserts 1220 are longitudinally disposed within the sole 1164 to control pronation and/or supination. The inserts 1220 can be inserted through the back of the heel region 1168 and extend to about the arch region 1172 of the sole 1164. The length of the insert 1220 and its position within the sole 1164 can vary to suit a particular application and/or a particular type of article of footwear. For example, the insert 1220 may not extend beyond the heel region 1168. In one embodiment, the sole 1164 can include an outsole 1170 and a midsole 1166, and the system 1212 can be disposed at least partially within the midsole 1166. Alternatively, the adjustable cushioning system 1212 can include only a single insert 1220 disposed either on-center or offset from the midline of the sole 1164.

Figure 13:
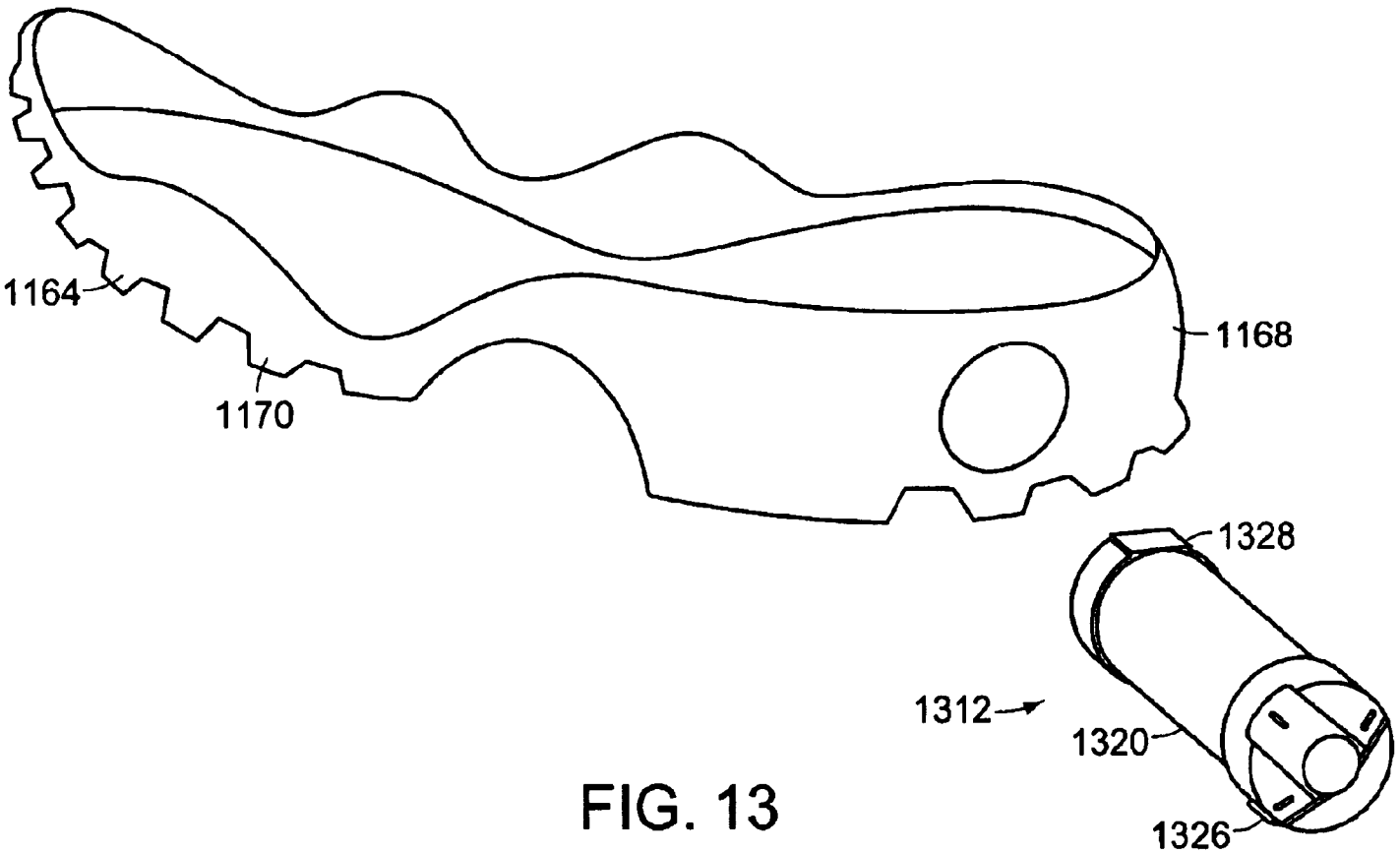
FIG. 13 is a partially exploded perspective view of the sole of FIG. 1B including another embodiment of an adjustable cushioning system in accordance with the invention.

FIG. 13 depicts the sole 1164 of FIG. 11B and another alternative embodiment of an adjustable cushioning system 1312. The adjustable cushioning system 1312 is shown removed from the sole 1164. The adjustable cushioning system 1312 includes a single insert 1320 generally diagonally disposed in the heel region 1168 of the sole 1164. The insert 1320 shown includes a casing 1326, 1328 located on each end. The insert 1320 can span substantially the entire width of the sole 1164. In one embodiment, the adjustable cushioning system 1312 can be disposed at least partially within a midsole. In another embodiment, the insert 1320 can be positioned diagonally across the heel strike zone of the sole 1164.

FIGS. 14A–14F are rear views of a right footed article of footwear 1460 in accordance with the invention. The article of footwear 1460 includes an upper 1462, a sole 1464, and an adjustable cushioning system 1412 with two inserts 1420 generally longitudinally disposed within a heel region 1468 of the sole 1464. In various embodiments, the system 1412 could include only one insert 1420 or more than two inserts 1420, and the inserts 1420 could be generally laterally or diagonally disposed in the sole 1464. Each view represents a possible combination of insert orientations. The examples shown are not meant to be exhaustive and other combinations are possible. The wearer can customize the level of cushioning in the footwear 1460 by rotating the insert 1420 relative to the article of footwear 1460. Additionally, inserts 1420 having different properties can be substituted for further customization of the article of footwear 1460.

Figure 14A:
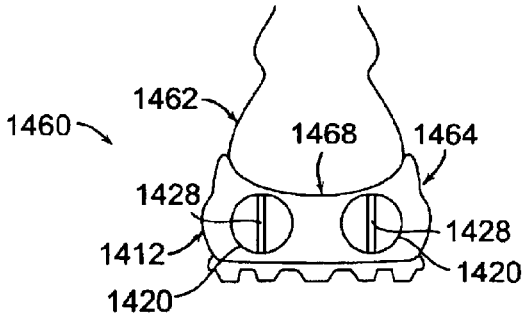
FIGS. 14A–14F are schematic rear views of an article of footwear with an adjustable cushioning system disposed therein in various rotational orientations.
Figure 14B:
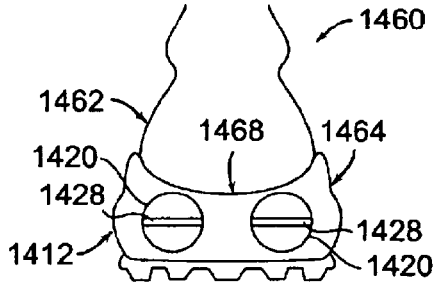

In FIG. 14A, the inserts 1420, as represented by orientation indicators 1428, are both in a "vertical" position, i.e. perpendicular to the ground, which results in the firmest possible cushioning. The internal structure, for example the skeletal element(s) 56, act as joists to increase support and stiffen the ride of the article of footwear 1460. FIG. 14B depicts both inserts 1420 in a "horizontal" position, i.e., parallel with the ground, which results in the softest cushioning. In the horizontal position, the insert 1420 allows the article of footwear 1460 more flex. The wearer can further customize the performance characteristics of the article of footwear 1460 by positioning each insert 1420 between the horizontal position and the vertical position.

Figure 14C:
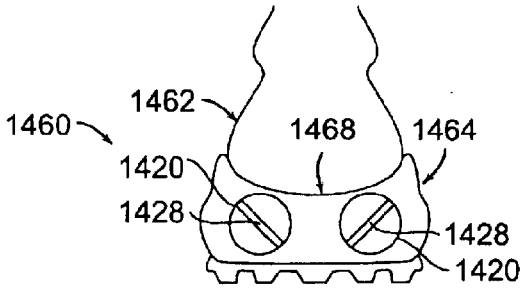
Figure 14D:
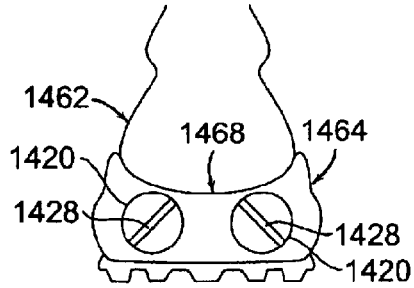

FIGS. 14C and 14D depict two other possible combinations where the inserts 1420 are oriented symmetrically. In both views, the inserts 1420 are positioned at about 45 degrees to normal, resulting in a moderate amount of cushioning.

Figure 14E:
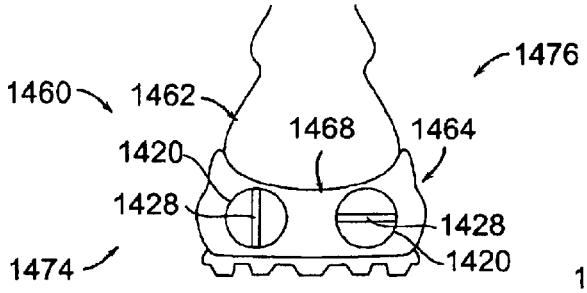
Figure 14F:
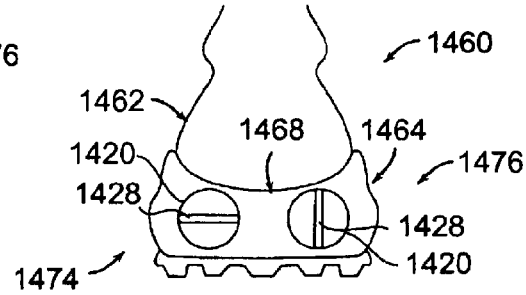

Alternatively, the inserts 1420 can be oriented in non-symmetrical positions, as shown in FIGS. 14E and 14F. In FIG. 14E, the insert 1420 located on the medial side 1474 is oriented to maximize the stiffness of the medial side 1474 of the sole 1464 relative to the lateral side 1476 of the sole 1464, where the insert 1420 is oriented to maximize cushioning. In such an arrangement, the increased stiffness on the medial side 1474 helps to prevent pronation. The wearer can vary the position of the insert 1420 to vary the amount of compensation for pronation.

In FIG. 14F, the insert 1420 located on the lateral side 1476 is oriented to maximize the stiffness of the lateral side 1476 of the sole 1464 relative to the medial side 1474 of the sole 1464, where the insert 1420 is oriented to maximize cushioning. In such an arrangement, the increased stiffness on the lateral side 1476 helps to prevent supination. The wearer can vary the position of the insert 1420 to vary the amount of compensation for supination.

Figure 15A:
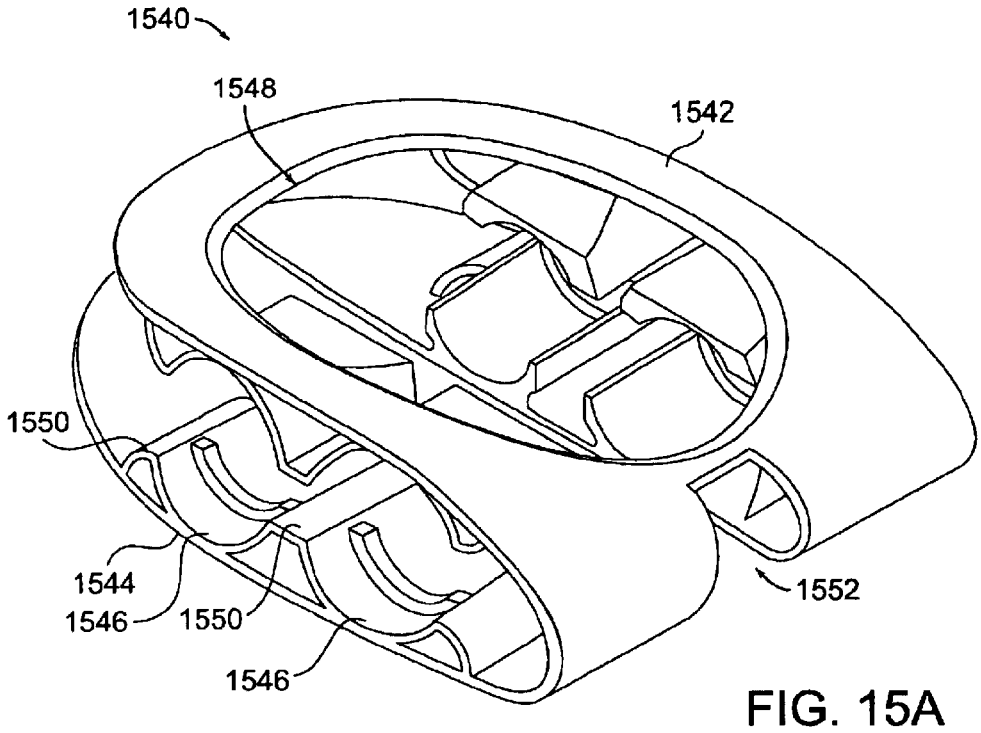
FIGS. 15A and 15B are schematic perspective views of an alternative embodiment of a casing for receiving an adjustable cushioning system in accordance with the invention.
Figure 15B:
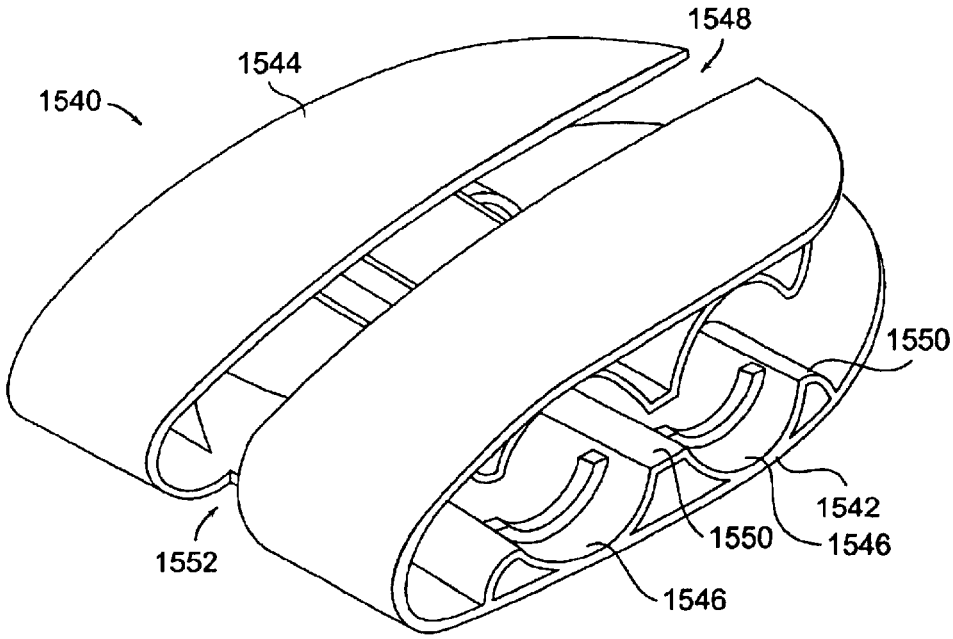

FIGS. 15A and 15B are top and bottom perspective schematic views, respectively, of an alternative casing 1540 for use with an adjustable cushioning system 1512 (FIG. 16) in accordance with the invention. The casing 1540 is typically disposed in a heel region of the article of footwear and may provide stability and support to the wearer's foot, while the inserts 1520 provide the adjustable cushioning. The casing 1540 is a substantially recumbent U-shape with a top platform 1542, a bottom platform 1544, and two recesses 1546 generally laterally disposed within the casing 1540 for receiving the two inserts 1520. Alternatively, the casing 1540 can have one recess 1546 or more than two recesses 1546, depending on the number of inserts 1520 that make up a particular embodiment of the adjustable cushioning system 1512. Also, the casing size and shape can vary to suit a particular application and/or a particular type of article of footwear. The casing 1540 has an optional aperture 1548 generally centrally disposed in the top platform 1542 and an optional slot 1552 that runs generally longitudinally along the bottom platform 1544. In the embodiment shown, the slot 1552 runs along the bottom platform 1544 and up to the top platform 1542. The casing 1540 can include stiffening ribs 1550 that hold the inserts 1510 in place, while adding stiffness to the overall casing 1540. The casing 1540 can also be manufactured of any of the materials and any of the processes discussed hereinabove.

Figure 16:
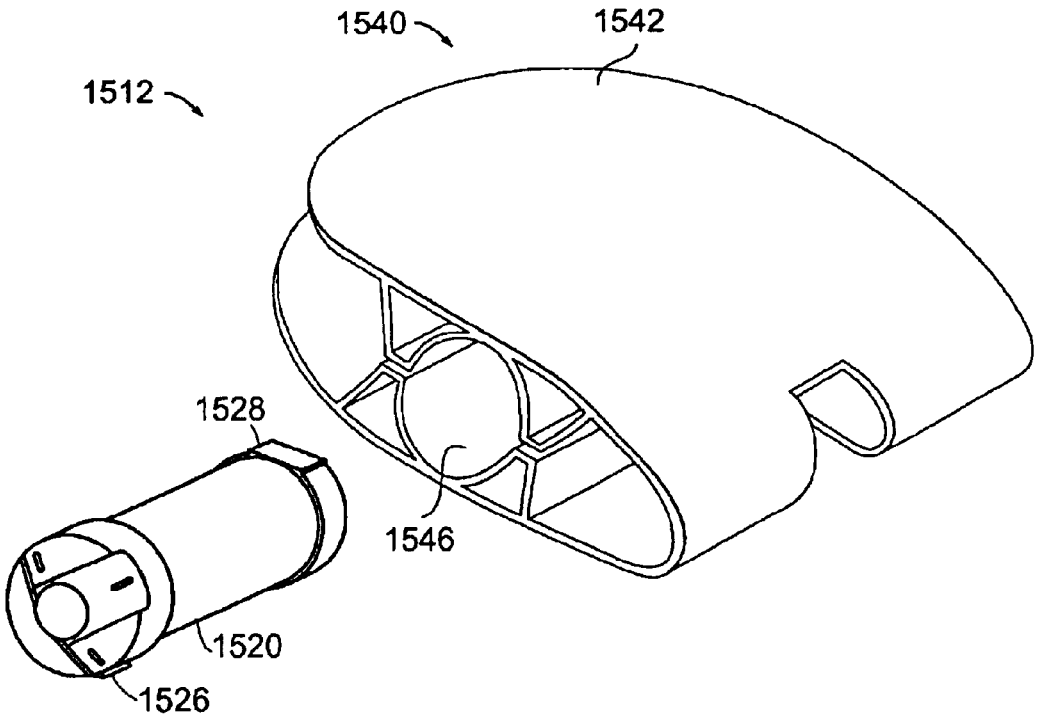
FIG. 16 is an exploded perspective view of a casing and a single insert.
Figure 4B:
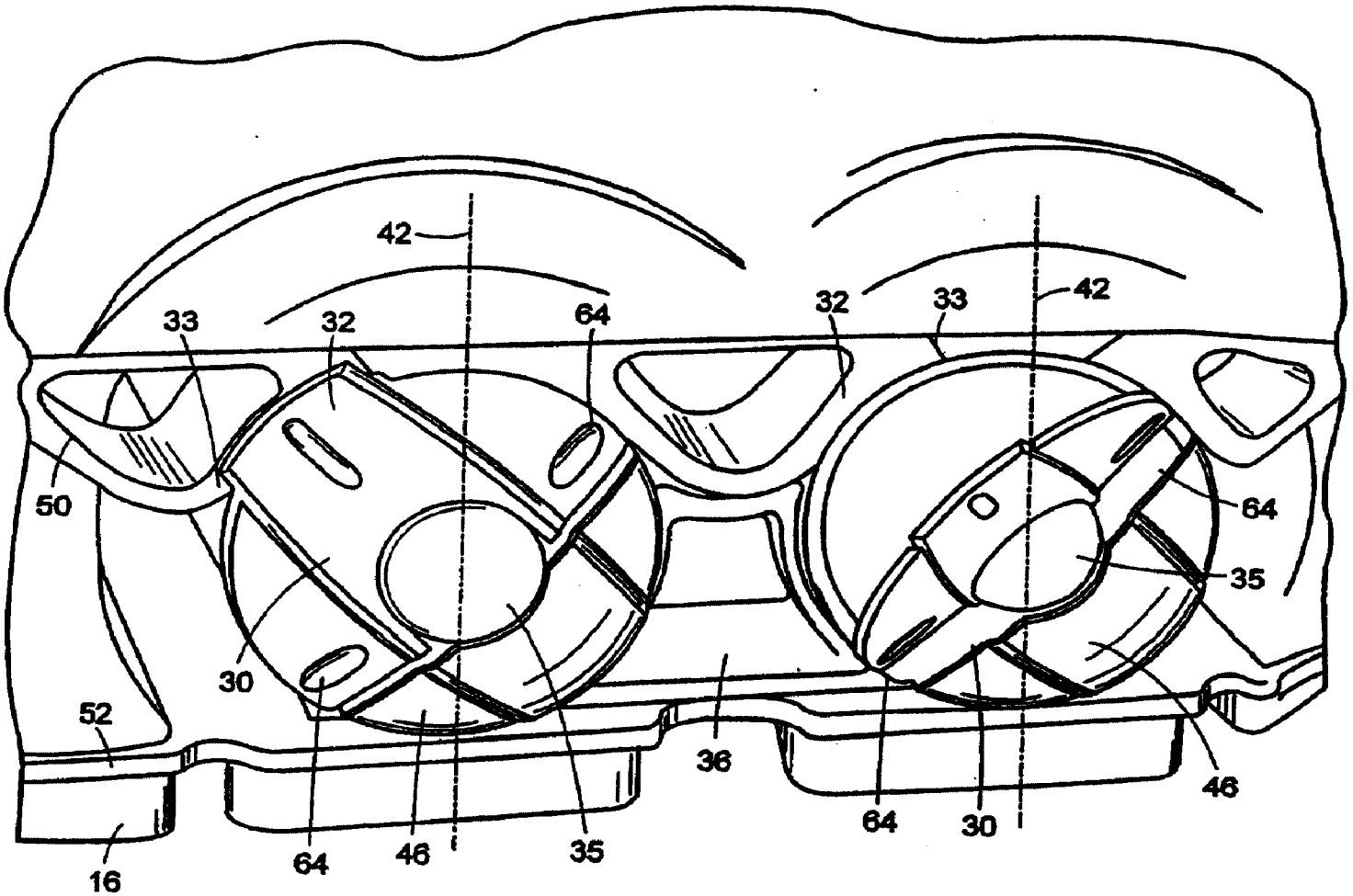

FIG. 16 is an exploded perspective view of an adjustable cushioning system 1512 in accordance with the invention. The system 1512 includes an insert 1520 and a casing 1540. The casing 1540 is a single molded piece with a single, laterally disposed recess 1546 for receiving the insert 1520. Alternatively, the recess 1546 and insert 1520 could be longitudinally or angularly disposed within the casing 1540.

Having described certain embodiments of the invention, it will be apparent to those of ordinary skill in the art that other embodiments incorporating the concepts disclosed herein may be used without departing from the spirit and scope of the invention. For example, the inserts and the mating apertures in the casings can be splines or have non-circular cross-sections, so that the inserts must be removed to be reoriented and then reinstalled. In this manner, the need for separate locking mechanisms can be obviated. Accordingly, the described embodiments are to be considered in all respects as only illustrative and not restrictive.

What is claimed is:

1. An adjustable cushioning system for an article of footwear, the system comprising:

an insert adapted to be received in an aperture formed in a sole of the article of footwear, wherein the insert has an anisotropic property about a longitudinal axis thereof and can be reoriented rotationally in the article of footwear to modify a performance characteristic thereof;

a locking mechanism disposed proximate the insert for maintaining the insert in a predetermined orientation; and a casing disposable in the sole and defining a recess for receiving the insert, wherein the casing is adapted to support a load of a user passing generally vertically therethrough.

2. The adjustable cushioning system of claim 1, wherein the insert comprises a multiple density foam.

3. The adjustable cushioning system of claim 1, wherein the insert comprises a skeletal element.

4. The adjustable cushioning system of claim 1, wherein the insert comprises a skeletal element and a multiple density foam.

5. The adjustable cushioning system of claim 1, wherein the anisotropic property is selected from the group consisting of compressibility, resiliency, compliancy, elasticity, damping, energy storage, and stiffness.

6. The adjustable cushioning system of claim 1, wherein the locking mechanism comprises:

a lever coupled to the insert for rotatably positioning the insert; and a groove for receiving and maintaining the lever in a predetermined position.

7. The adjustable cushioning system of claim 6, wherein the lever has a locked position and an unlocked position.

8. The adjustable cushioning system of claim 6, wherein the locking mechanism further comprises a second groove for receiving and maintaining the lever in a second predetermined position.

9. The adjustable cushioning system of claim 6, wherein the groove is disposed in the casing.

10. The adjustable cushioning system of claim 6, wherein the locking mechanism further comprises:

a detent; and an engagement mechanism disposed adjacent the detent, the engagement mechanism having a notch engageable with the detent.

11. The adjustable cushioning system of claim 6, wherein the locking mechanism further comprises at least one of a visual position indicator and an audible position indicator.

12. The adjustable cushioning system of claim 1, wherein the locking mechanism is at least partially disposed within a retainer ring circumscribing an end of the insert.

13. The adjustable cushioning system of claim 1, wherein the locking mechanism is disposable on a medial side of the article of footwear.

14. The adjustable cushioning system of claim 1, wherein the locking mechanism is disposed on a lateral side of the article of footwear.

15. The adjustable cushioning system of claim 1, wherein the insert further comprises a shaft generally longitudinally disposed therein.

16. The adjustable cushioning system of claim 1, wherein the insert has a generally cylindrical shape.

17. The adjustable cushioning system of claim 1, wherein the casing comprises a retainer ring that circumscribes an end of the insert.

18. The adjustable cushioning system of claim 17 further comprising a second casing, wherein the second casing comprises a retainer ring that circumscribes an opposite end of the insert.

19. The adjustable cushioning system of claim 1, wherein the casing comprises a first plate disposed above the insert and a second plate disposed below the insert and coupled to the first plate at an end thereof.

20. The adjustable cushioning system of claim 1, wherein the insert defines a generally longitudinally disposed aperture.

21. The adjustable cushioning system of claim 20, wherein the insert defines a second generally longitudinally disposed aperture.

22. The adjustable cushioning system of claim 1, wherein the insert further comprises a cap disposed on an end thereof.

23. The adjustable cushioning system of claim 1, wherein the insert further comprises an orientation indicator disposed on an end thereof.

24. The adjustable cushioning system of claim 1 further comprising:

a second insert adapted to be received in the aperture formed in the sole of the article of footwear, wherein the second insert has an anisotropic property about a longitudinal axis thereof and can be reoriented rotationally in the article of footwear to modify a performance characteristic thereof; and a second locking mechanism disposed proximate the second insert for maintaining the second insert in a predetermined orientation.

25. The adjustable cushioning system of claim 24, wherein the second insert is oriented generally parallel to the first insert.

26. The adjustable cushioning system of claim 1, wherein the insert comprises:

an internal support; and an external cushioning element disposed about at least a portion of the internal support.

27. The adjustable cushioning system of claim 26, wherein the external cushioning element has a lower durometer than the internal support.

28. The adjustable cushioning system of claim 26, wherein the insert further comprises an axle disposed within the internal support.

29. The adjustable cushioning system of claim 26, wherein the internal support has a cross section selected from the group consisting of polygonal, arcuate, and combinations thereof.

30. The adjustable cushioning system of claim 26, wherein the internal support substantially spans an entire width of the insert.

31. An article of footwear comprising a sole and an adjustable cushioning system, the system comprising:

an insert adapted to be received in an aperture formed in the sole of the article of footwear, wherein the insert has an anisotropic property about a longitudinal axis thereof and can be reoriented rotationally in the article of footwear to modify a performance characteristic thereof;

a locking mechanism disposed proximate the insert for maintaining the insert in a predetermined orientation.

32. The article of footwear of claim 31, wherein the insert is disposed in a heel region of the sole of the article of footwear.

33. The article of footwear of claim 31, wherein the insert is disposed in a forefoot region of the sole of the article of footwear.

34. The article of footwear of claim 31, wherein the locking mechanism is disposed on a medial side of the sole.

35. The article of footwear of claim 31, wherein the locking mechanism is disposed on a lateral side of the sole.

36. The article of footwear of claim 31, wherein the sole comprises an outsole and a midsole and the insert is disposed at least partially in the midsole.

37. The article of footwear of claim 31, wherein the system further comprises:

a second insert adapted to be received in the aperture formed in the sole of the article of footwear, wherein the second insert has an anisotropic property about a longitudinal axis thereof and can be reoriented rotationally in the article of footwear to modify a performance characteristic thereof; and a second locking mechanism disposed proximate the second insert for maintaining the second insert in a predetermined orientation.

38. The article of footwear of claim 31, wherein the insert is generally longitudinally disposed within the article of footwear.

39. The article of footwear of claim 39, wherein the insert extends from a heel region to an arch region of the article of footwear.

40. The article of footwear of claim 31, wherein the insert is generally laterally disposed within the article of footwear.

41. The article of footwear of claim 40, wherein the insert spans substantially an entire width of the article of footwear.

42. The article of footwear of claim 31, wherein the insert is diagonally disposed within the article of footwear.

43. The article of footwear of claim 31, wherein the insert is removable from the article of footwear.

* * * * *

UNITED STATES PATENT AND TRADEMARK OFFICE

CERTIFICATE OF CORRECTION

PATENT NO. : 6,807,753 B2
APPLICATION NO. : 10/144440
DATED : October 26, 2004
INVENTOR(S) : Michael Steszyn et al.

It is certified that error appears in the above-identified patent and that said Letters Patent is hereby corrected as shown below:

Drawings,
Replace figure 4B with new figure 4B as shown on the attached page.

Signed and Sealed this

Twenty-seventh Day of June, 2006

JON W. DUDAS
*Director of the United States Patent and Trademark Office*